US010118790B2

(12) United States Patent
Matsuki et al.

(10) Patent No.: US 10,118,790 B2
(45) Date of Patent: Nov. 6, 2018

(54) SHEET PROCESSING APPARATUS AND IMAGE FORMING APPARATUS HAVING THE SAME

(71) Applicants: Satoru Matsuki, Yamanashi-ken (JP); Daiki Komiya, Yamanashi-ken (JP); Kazuhito Shimura, Yamanashi-ken (JP)

(72) Inventors: Satoru Matsuki, Yamanashi-ken (JP); Daiki Komiya, Yamanashi-ken (JP); Kazuhito Shimura, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 15/630,429

(22) Filed: Jun. 22, 2017

(65) Prior Publication Data

US 2017/0283208 A1 Oct. 5, 2017

Related U.S. Application Data

(63) Continuation of application No. 14/583,334, filed on Dec. 26, 2014, now Pat. No. 9,725,275.

(30) Foreign Application Priority Data

Dec. 27, 2013 (JP) ..... 2013-272226

(51) Int. Cl.
*B65H 37/04* (2006.01)
*B65H 43/00* (2006.01)
(Continued)

(52) U.S. Cl.
CPC ..... *B65H 37/04* (2013.01); *B31F 5/001* (2013.01); *B42C 1/12* (2013.01); *B65H 9/10* (2013.01);
(Continued)

(58) Field of Classification Search
CPC ..... B65H 9/10; B65H 9/101; B65H 31/34; B65H 37/04; B65H 2301/3621;
(Continued)

(56) References Cited

U.S. PATENT DOCUMENTS 8,342,499 B2 * 1/2013 Shiraishi ..... B65H 31/3027 270/58.08
8,444,133 B2 5/2013 Kimura
(Continued)

FOREIGN PATENT DOCUMENTS

JP 2011-256009 A 12/2011
JP 2013-126911 A 6/2013

OTHER PUBLICATIONS

Japan Patent Office, "Office Action for Japanese Patent Application No. 2013-272226," dated Jul. 19, 2017.

*Primary Examiner* — Leslie A Nicholson, III
(74) *Attorney, Agent, or Firm* — Manabu Kanesaka

(57) ABSTRACT

A sheet processing apparatus includes a stack portion on which sheets conveyed in a conveying direction are stacked, a first regulating portion regulating a position of a sheet bundle stacked on the stack portion in a crossing direction crossing the conveying direction by contacting an end of the sheet bundle in the crossing direction, a second regulating portion regulating a position of the sheet bundle in the conveying direction by contacting an end of the sheet bundle in the conveying direction, a first binding device which moves in the crossing direction and binds by a staple, a second binding device which moves and binds without a staple, and a controller which controls the first and second binding devices. The first and second binding devices bind the corner portion of the sheet bundle.

8 Claims, 16 Drawing Sheets

(51) Int. Cl.

| | |
|---|---|
| ***B65H 31/04*** | (2006.01) |
| ***B65H 31/34*** | (2006.01) |
| ***B31F 5/00*** | (2006.01) |
| ***B65H 9/10*** | (2006.01) |
| ***B42C 1/12*** | (2006.01) |
| ***G03G 15/00*** | (2006.01) |
| *B31F 5/02* | (2006.01) |
| *B31F 1/07* | (2006.01) |

(52) U.S. Cl.
CPC ..... *B65H 9/101* (2013.01); *B65H 31/04* (2013.01); *B65H 31/34* (2013.01); *B65H 43/00* (2013.01); *G03G 15/6541* (2013.01); *G03G 15/6544* (2013.01); *B31F 1/07* (2013.01); *B31F 5/02* (2013.01); *B65H 2301/3621* (2013.01); *B65H 2801/27* (2013.01)

(58) Field of Classification Search
CPC ..... B65H 2801/27; B42C 1/12; B31F 5/001; B31F 5/02; B31F 1/07
USPC ..... 270/58.07, 58.08, 58.11, 58.12, 58.17, 270/58.27
See application file for complete search history.

(56) References Cited

U.S. PATENT DOCUMENTS

| | | | | |
|---|---|---|---|---|
| 9,126,794 | B2 * | 9/2015 | Abe | G03G 15/6541 |
| 9,555,997 | B2 * | 1/2017 | Yabe | B65H 39/00 |
| 9,567,183 | B2 * | 2/2017 | Komiyama | B42B 5/08 |
| 9,567,184 | B2 * | 2/2017 | Kanemaru | B65H 31/02 |
| 2011/0304090 | A1 | 12/2011 | Kimura | |

* cited by examiner

SHEET PROCESSING APPARATUS AND IMAGE FORMING APPARATUS HAVING THE SAME

CROSS-REFERENCE TO RELATED APPLICATION

This is a continuation application of Ser. No. 14/583,334 filed on Dec. 26, 2014, which claims priority of Japanese Patent Application No. 2013-272226 filed on Dec. 27, 2013, the disclosure of which is incorporated herein.

BACKGROUND OF THE INVENTION

1. Field of the Invention

The present invention relates to a sheet processing apparatus which performs a binding process on sheets fed from an image forming apparatus, and relates to improvement of a binding processing mechanism to perform a binding process as collating and stacking image-formed sheets and selecting one of different binding processing devices.

2. Description of Related Arts

In general, there has been known a sheet binding processing apparatus in which sheets image-formed at an image forming apparatus are collated and stacked on a processing tray after being guided from a sheet introducing path, a binding process using a staple is performed on the sheets which are formed into a sheet bundle, and the bound sheet bundle is stacked on a stack tray.

Such sheet binding processing apparatuses are categorized into a sheet bundle moving type with which a binding process is performed after a stacked sheet bundle is moved to a binding processing position of a binding processing unit and a unit moving type with which a binding process is performed after a binding processing unit is moved to a predetermined position of a stacked sheet bundle. Here, the sheet bundle moving type has following problems and the like.

(1) A sheet bundle is easy to be disarranged in posture when being moved and appearance of a processed sheet bundle becomes worse owing to that a binding process is performed in a state of disarranged posture.

(2) The apparatus is upsized as a whole owing to a space required for moving a whole sheet bundle.

Accordingly, sheet binding processing apparatuses of the unit moving type have been widely used in the market.

Meanwhile, recently, it has been desired in the market for a sheet binding processing apparatus in which a plurality of binding processing units is used separately. For example, there has been newly known a sheet binding processing apparatus which adopts a so-called non-stapling unit to perform a binding process on a sheet bundle with a method such as applying high pressure onto the sheet bundle without using a staple as well as to perform a binding process on a sheet bundle using a staple.

Japanese Patent Application Laid-open No. 2012-027118 discloses such a new sheet binding processing apparatus of the unit moving type in which both of a stapling unit and a non-stapling unit are arranged movably against a sheet bundle stacked on a processing tray and a binding process is to be performed at a predetermined binding position.

In the apparatus disclosed in Japanese Patent Application Laid-open No. 2012-027118, each unit is moved to the predetermined binding position to perform a binding process in a state that an end edge of a sheet bundle is introduced to an opening portion of the stapling unit and an opening portion of the non-stapling unit.

Accordingly, there has been a problem that a sheet bundle is disarranged in posture owing to that sheets interfere with an opening portion of one unit when a binding process is to be performed on the sheet bundle by the other unit.

In particular, in a case that a binding processing unit having a low binding processing capacity and a narrow opening portion is included in a plurality of binding processing units, the problem such as sheet bundle disarrangement appears notably. Further, in a case that differences exist among processing capacities of the binding processing units, there has been a problem that an expected processing capacity cannot be obtained owing to that the number of sheets to be processed by a binding processing unit having a high processing capacity with respect to the number of sheets to be processed is limited to the number of sheets to be processed by a binding processing unit having a low binding processing capacity.

SUMMARY OF THE INVENTION

An object of the present invention is, in a sheet binding processing apparatus including a plurality of binding processing units, to prevent a sheet bundle from being disarranged in posture to be caused by interference of the sheet with a binding processing unit when another binding processing unit performs a binding process on the sheet bundle. Further, another object thereof is to avoid the number of sheets to be processed by a binding processing unit having a high processing capacity with respect to the number of sheets to be processed from being limited by a binding processing unit having a low processing capacity.

To solve the abovementioned problems, in the present invention, a controller controls a driving device so that one of first and second binding devices is moved to a waiting position at the outside of sheets when the other thereof is moved to a binding position.

For more details, the present invention provides an apparatus which includes the first and second binding devices to perform a binding process with the selected binding device at the binding position of a sheet bundle positioned on a processing tray (37). Here, the apparatus includes the processing tray on which sheets are stacked, a sheet positioning device (38) which positions sheets at the predetermined binding position as being arranged at the processing tray, the first and second binding devices which are arranged to be movable between a predetermined binding position (Cp1) and a waiting position (Wp) distanced from the binding position with reference to the sheets positioned at the processing tray, a driving device (M3) which selectively moves the first and second binding devices, and the controller (95) which controls the driving device.

Further, the retracting positions of the first and second binding devices are arranged to be opposed to each other as sandwiching the binding position, and the first and second binding devices are controlled to be moved contrary by the common driving device between the waiting position and the binding position.

According to the present invention, the first and second binding units are arranged to be moved contrary between the binding position set to a predetermined position of sheets introduced onto the tray and the waiting position retracting from the binding position. Accordingly, following effects are produced.

The first and second binding units which are movably arranged at the processing tray are to be moved contrary to the waiting positions which are distanced respectively to the opposite sides as sandwiching the predetermined binding position such as a sheet corner.

That is, the second binding unit is located at the waiting position when the first binding unit is at the binding position and the first binding unit is located at the waiting position when the second binding unit is at the binding position. Here, it is possible to drive the first and second binding units with a common drive mechanism (a drive motor, a transmitting mechanism, or the like). Accordingly, the apparatus can be downsized with a simple structure to move the first and second binding units.

Further, the waiting position of the first binding unit and the waiting position of the second binding unit are set at the outside (outer side) of a sheet introduction area toward the processing tray, that is, at the outside of sheets on the processing tray. Accordingly, for example, the second binding unit having a low processing capacity with respect to the number of sheets to be processed can be moved to the waiting position when the first binding unit having a high processing capacity is at the binding position.

According to the structure described above, a sheet bundle is prevented from being disarranged in posture to be caused by interference of the sheet bundle with the second binding unit when the first binding unit performs a binding process thereon. Further, the number of sheets on which a binding process is to be performed by the first binding unit is not limited by the binding processing capacity of the second binding unit having a low binding processing capacity.

Further, according to the present invention, the first binding unit and the second binding unit can be contrary moved respectively by a first movement stroke and a second movement stroke. Accordingly, it is possible to prevent occurrence of a problem of cost increase caused by linking separate drive motors and a problem of collision between units caused by computer runaway.

BRIEF DESCRIPTION OF THE DRAWINGS

FIGS. 10A-10C illustrate structures of binding devices according to the present invention, while FIG. 10A is a structural explanatory view of the stapling unit, FIG. 10B is a structural explanatory view of the eco-binding unit, and FIG. 10C illustrates a state right before the sheet bundle is discharged;

FIGS. 14A and 14B illustrate flows of a sheet discharging mode with the apparatus of FIG. 1, while FIG. 14A is an operational flowchart of a bookbinding sheet discharging mode and FIG. 14B is an operational flowchart of a printout sheet discharging mode;

DETAILED DESCRIPTION OF THE PREFERRED EMBODIMENT

[Image Forming System]

Figure 1:
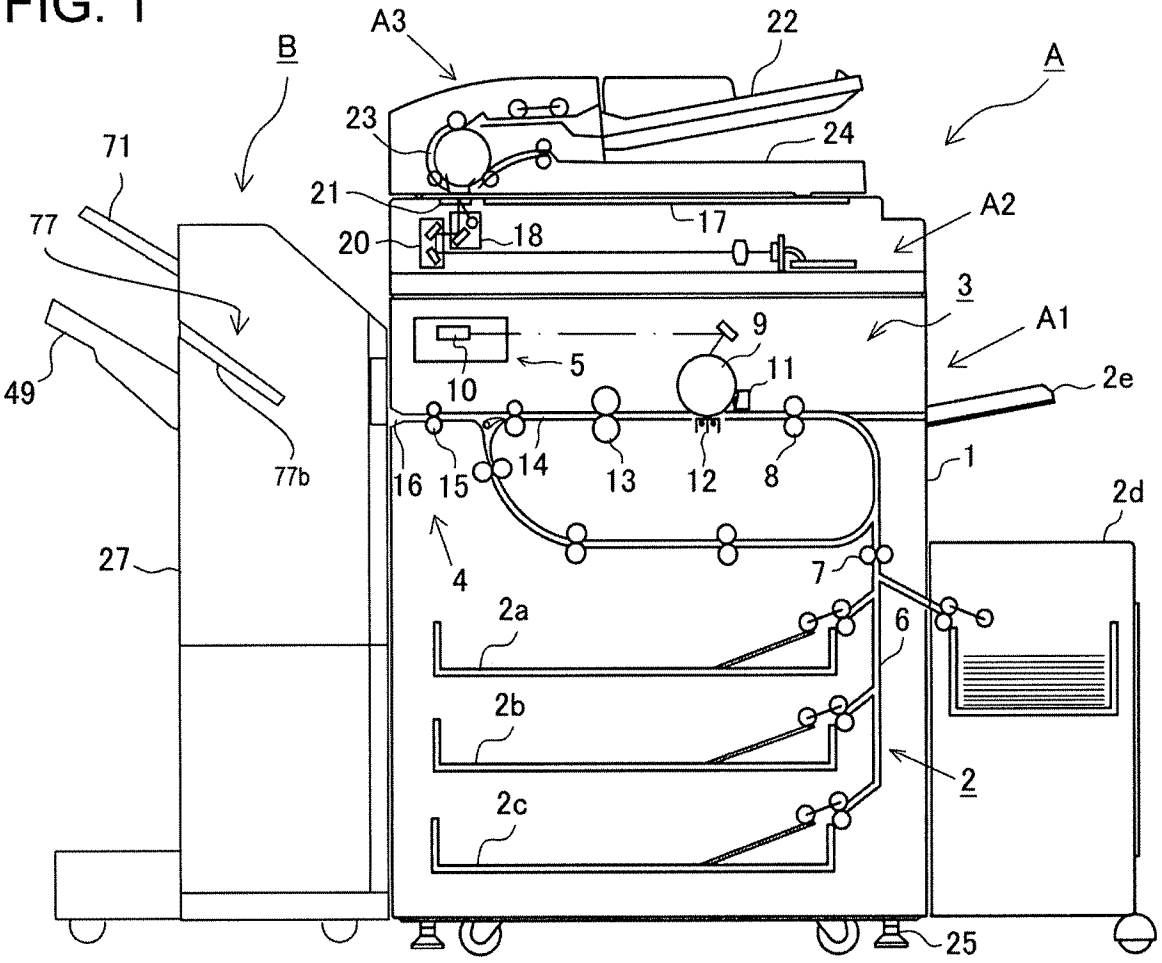
FIG. 1 is an explanatory view of a whole configuration of an image forming system according to the present invention.

In the following, the present invention will be described according to illustrated preferred embodiments. As illustrated in FIG. 1, the present invention relates to a sheet post-processing apparatus B which performs a binding process, a folding process, or another post-process on a sheet on which an image is formed at an image forming apparatus A and an image forming system having the same.

The image forming apparatus A forms an image on a sheet based on image data read by a copying machine, a facsimile machine, a printer, a printing machine, or the like or image data transferred from the outside. That is, the image forming apparatus A is structured as an image forming portion of an output terminal of a computer network, a copying system, a facsimile system, or the like. Here, the image forming apparatus A adopts a structure (stand-alone structure) to form an image on a sheet based on data read by an image reading portion of a system or a structure (network structure) to form an image on a sheet based on image data prepared or read in a computer network. Description will be provided on the image forming apparatus A and the sheet post-processing apparatus B in the order thereof with reference to FIG. 1 which illustrates a network structure.

[Image Forming Apparatus]

Description will be provided on an image forming apparatus A in an image forming system illustrated in FIG. 1. In the drawing, the image forming apparatus A has an electrostatic printing mechanism as including an image forming unit A1, a scanner unit A2, and a feeder unit A3. Emplacement legs 25 for emplacing on an installation face (e.g., a floor face) are arranged at an apparatus housing 1. Further, the apparatus housing 1 accommodates a sheet feeding portion 2, an image forming portion 3, a sheet discharging portion 4, and a data processing portion 5.

The sheet feeding portion 2 is structured with cassette mechanisms 2*a* to 2*c* to store sheets having a plurality of sizes on which images are formed and feeds a sheet having a specified size from a main body controller 90 to a sheet feeding path 6. The plurality of cassettes 2*a* to 2*c* are arranged at the apparatus housing 1 in a detachably attachable manner. Each cassette contains a separating mechanism to separate stored sheets one by one and a sheet feeding mechanism to feed a sheet. A conveying roller 7 which feeds sheets fed from the plurality of cassettes 2*a* to 2*c* to the downstream side is arranged at the sheet feeding path 6. A pair of resist rollers 8 are arranged at an end of the path so that each sheet is aligned at a leading end thereof.

A large-capacity cassette 2*d* and a manual tray 2*e* are connected to the sheet feeding path 6. The large-capacity cassette 2*d* is structured as an optional unit which stores sheets having a size to be used in great quantities. The manual tray 2*e* is structured to be capable of feeding special sheets such as thick sheets, coating sheets, and film sheets which are difficult to be separately fed.

An electrostatic printing mechanism is illustrated as an example of the image forming portion 3. A photo conductor 9 (drum, belt), a light emitter 10 which emits an optical beam to the photo conductor 9, a developer 11, and a cleaner (not illustrated) are arranged around the photo conductor 9 which rotates. The drawing illustrates a monochrome printing mechanism. Here, a latent image is optically formed at the photo conductor 9 by the light emitter 10. The developer 11 causes toner ink to adhere to the latent image.

A sheet is fed from the sheet feeding path 6 to the image forming portion 3 in accordance with image-forming timing on the photo conductor 9. Then, the image is transferred onto the sheet at a transfer charger 12 and fixed by a fixing unit (roller) 13 which is arranged at the sheet discharging path 14. A sheet discharging roller 15 and a sheet discharging port 16 are arranged at the sheet discharging path 14 for conveying a sheet to a sheet post-processing apparatus B which is described later.

The scanner unit A2 is structured with a platen 17 on which an image document is placed, a carriage 18 which reciprocates along the platen 17, a light source which is mounted on the carriage 18, and a reducing optical system 20 (combination of a mirror and a lens) which guides reflection light from the document on the platen 17 to a photoelectric conversion device 19. A second platen (drive platen) 21 is illustrated in the drawing. The carriage 18 and the reducing optical system 20 read an image of the sheet fed from the feeder unit A3. The photoelectric conversion device 19 electrically transfers photoelectrically-converted image data to the image forming portion 3.

The feeder unit A3 is structured with a sheet feeding tray 22, a sheet feeding path 23 which guides a sheet fed from the sheet feed tray 22 to the drive platen 21, and a sheet discharge tray 24 which stores a document, an image of which is read at the drive platen 21.

Not limited to the abovementioned mechanism, the image forming apparatus A may adopt a printing mechanism such as an offset printing mechanism, an ink jet printing mechanism, and an ink ribbon transfer printing mechanism (thermal transfer ribbon printing, sublimation ribbon printing, or the like).

[Sheet Post-Processing Apparatus]

As an apparatus to perform post-processing on sheets discharged from the sheet discharging port 16 of the image forming apparatus A, the sheet post-processing apparatus B has following functions as;

(1) A function to stack and store image-formed sheets (first and third processing portions B1, B3; a printout mode),
(2) A function to sort and store image-formed sheets (third processing portion B3; a jog sorting mode),
(3) A function to collate and stack image-formed sheets and perform a binding process thereon (first processing portion B1; a binding processing mode), and
(4) A function to perform bookbinding with a folding process after image-formed sheets are collated and a binding process is performed thereon (second processing portion B2; a bookbinding processing mode).

In the present invention, the sheet post-processing apparatus B is not necessarily required to have all the abovementioned functions. The sheet post-processing apparatus B may be appropriately arranged in accordance with apparatus specifications (design specifications). Even in this case, it is required to include a processing portion (the first processing portion B1) which collates and stacks sheets, a first binding device (later-described staple binding unit 47) which has a high processing capacity with respect to the number of sheets to be processed, and a second binding device (later-described non-staple binding unit 51) which has a lower processing capacity than that of the first binding device with respect to the number of sheets to be processed, the first and second binding devices being arranged at the first processing portion B1. Further, it is required to have a stack structure to perform stacking after a binding process is performed with a selected binding device.

Figure 2:
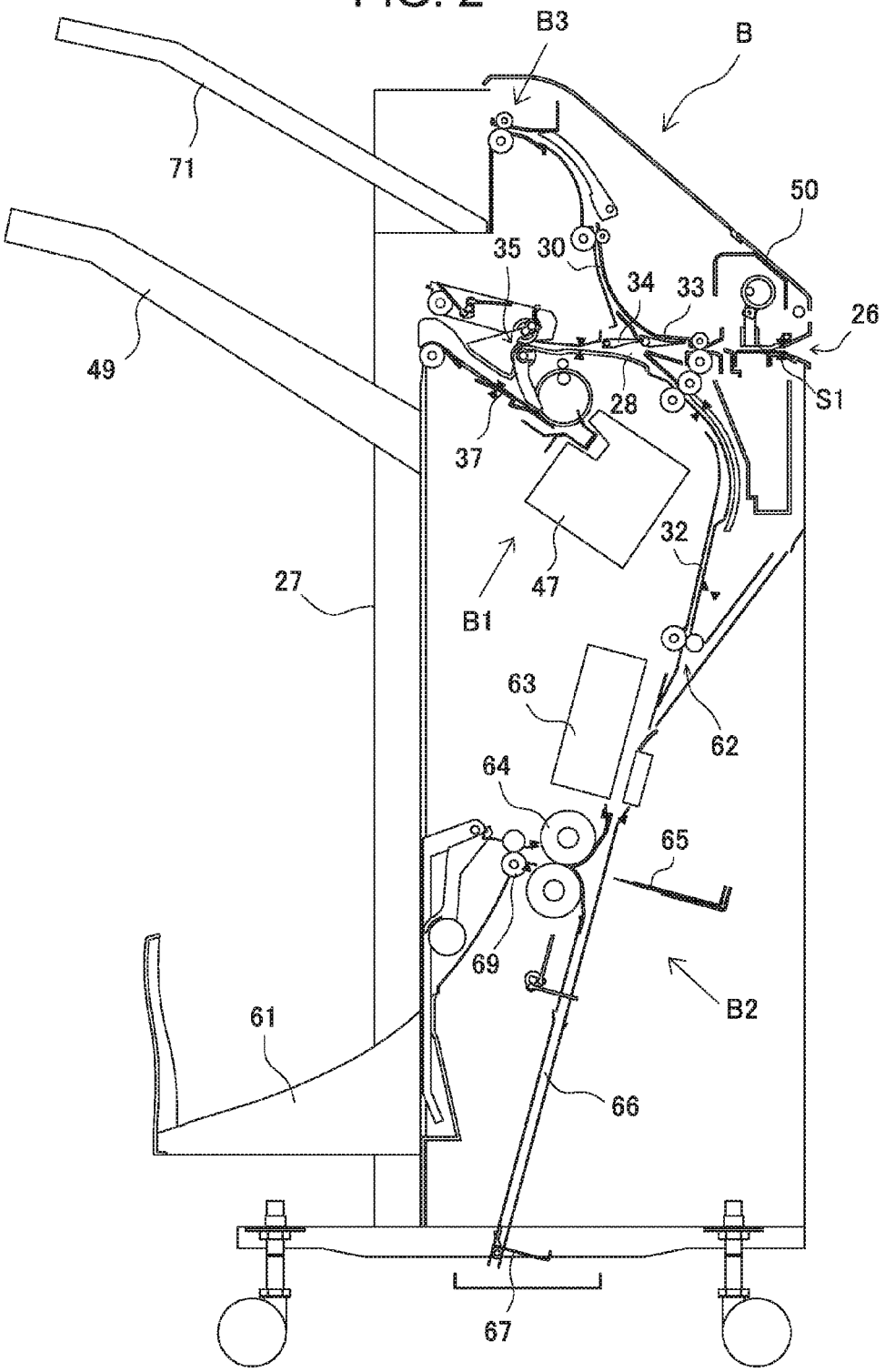
FIG. 2 is an explanatory view of a whole configuration of a post-processing apparatus in the image forming system of FIG. 1.

FIG. 2 illustrates a detailed structure of the sheet post-processing apparatus B. The sheet post-processing apparatus B includes an introducing port 26 which is connected to the sheet discharging port 16 of the image forming apparatus A and stores sheets introduced through the introducing port 26 at a storage portion (a first stack tray 49, a second stack tray 61, and a third stack tray 71 which are described later) after a post-process is performed thereon. In the post-processing apparatus B in the drawing, a sheet fed to a sheet introducing path 28 is conveyed to the first stack tray (hereinafter, called a first tray) 49 from the first processing portion B1, to the second stack tray (hereinafter, called a second tray) 61 from the second processing portion B2, or to the third stack tray (hereinafter, called a third tray) 71 from the third processing portion B3.

The first processing portion B1 is arranged at a path exit (sheet discharging port) 35 of the sheet introducing path 28. Here, sequentially-fed sheets are stored at the first stack tray (first storage portion) 49 after a binding process is performed thereon with the sheets being collated and stacked. The second processing portion B2 is arranged at a path exit (second switchback path end described later) 62 branched from the sheet introducing path 28. Here, a folding process is performed on sequentially-fed sheets and the sheets are stored at the second stack tray (second storage portion) 61 after a binding process is performed thereon with the sheets being collated and stacked. The third processing portion B3 is assembled to the sheet introducing path 28. Here, conveyed sheets are stored at the third stack tray (third storage portion) 71 after being offset by a predetermined amount in a perpendicular direction and sorted.

In the following, each structure will be described in detail.

[Apparatus Housing]

As illustrated in FIG. 2, the sheet post-processing apparatus B includes an apparatus housing 27, the sheet introducing path 28 which is embedded in the apparatus housing 27 as having the introducing port 26 and the sheet discharging port 35, the first to third processing portions B1, B2, B3 which perform a post-processing respectively on sheets fed from the sheet introducing path 28, and the first to third trays 49, 61, 71 which store sheets fed from the respective processing portions. The apparatus housing 27 in the drawing is arranged to have a height dimension from the installation face being approximately the same as the housing 1 of the image forming apparatus A which is located at the upstream side. Then, the sheet discharging port 16 of the image forming apparatus A and the introducing port 26 of the sheet post-processing apparatus B are connected.

[Sheet Introducing Path]

The sheet introducing path 28 is structured with a linear path which traverses the apparatus housing 27 approximately in the horizontal direction. The sheet introducing path 28 includes the introducing port 26 which is connected to the sheet discharging port (main body sheet discharging port) 16 of the image forming apparatus A, and the sheet discharging port 35 which is arranged at the opposite side to the introducing port 26 as traversing the apparatus. The sheet introducing path 28 is provided with a conveying roller 29 (a sheet conveying device such as a roller and a belt) which conveys a sheet from the introducing port 26 toward the sheet discharging port 35, a sheet discharging roller 36 (may be a belt as well) which is arranged at the sheet discharging port 35, an inlet sensor S1 which detects a leading end and a tailing end of a sheet to be introduced to the path, and a sheet discharging sensor S2 which detects a leading end and a tailing end of a sheet at the path sheet discharging port.

The sheet introducing path 28 is connected to the first processing portion B1 and the second processing portion B2 so that sheets are sorted and conveyed thereto from the introducing port 26. The second processing portion B2 is connected to the upstream side in the path sheet discharging direction and the first processing portion B1 is connected to the downstream side therein. The sheet introducing path 28 having an approximately linear shape is branched to convey a sheet from the introducing port 26 toward the second processing portion B2. Further, the sheet introducing path 28 is structured to guide a sheet from the introducing port 26 to the first processing portion B1 which is arranged at the downstream side of the path sheet discharging port 35.

Further, a third sheet discharging path (printout sheet discharging path) 30 which guides a sheet on which a post-process is not performed at the first processing portion B1 or the second processing portion B2 to the third tray 71 is connected to the sheet introducing path 28, so that a sheet is guided to the third tray (overflow tray) 71. The third processing portion B3 is arranged at the sheet introducing path 28. The third processing portion B3 performs jog sorting to sort a sheet to be conveyed on the path by offsetting the sheet in a direction perpendicular to a sheet discharging direction. That is, the third processing portion B3 is arranged at the sheet introducing path 28 and sheets jog-sorted at the third processing portion B3 are stored at the third tray 71.

As illustrated in FIG. 2, at the sheet introducing path 28, the third sheet discharging path 30, a second sheet discharging path 32, and a first sheet discharging path 31 are arranged in the order thereof from the introducing port 26 to the downstream side. A first path switching device 33 and a second path switching device 34 are arranged as illustrated in FIG. 2. The second sheet discharging path 32 and the first sheet discharging path 31 are structured as a switchback path which guides a sheet to each processing portion as reversing the sheet conveying direction.

The third sheet discharging path 30 guides sheets fed from the introducing port 26 to the third tray 71, the second sheet discharging path 32 guides sheets fed from the introducing port 26 to the second tray 61, and the first sheet discharging path 31 guides sheets fed from the introducing port 26 to the first tray 49. The third processing portion B3 performs a jog sorting process on sheets at the introducing path to be guided to the third tray 71, the second processing portion B2 performs a bookbinding process on sheets to be guided to the second tray 61, and the first processing portion B1 performs a binding process on sheets to be guided to the first tray 49.

The first path switching device 33 is structured with a flapper guide which changes a sheet conveying direction and is connected to a driving device such as an electromagnetic solenoid and a miniature motor (not illustrated). At the first path switching device 33, a sheet fed from the introducing port 26 is selected to be guided to the third sheet discharging path 30 or to the first and second sheet discharging paths 31, 32. At the second path switching device 34, a sheet fed from the introducing port 26 is selected to be guided to the second processing portion B2 or the first processing portion B1 at the downstream side thereof. A driving device (not illustrated) is connected to the second path switching device 34 as well. Further, a punch unit 50 which forms a punch hole at an introduced sheet is arranged at the sheet introducing path 28.

[First Processing Portion]

The first processing portion B1 arranged at the downstream side of the sheet introducing path 28 is structured with the processing tray 37 which collates and stacks sheets fed from the sheet discharging port 35 and a binding processing mechanism which performs a binding process on a stacked sheet bundle. As illustrated in FIG. 2, a step is formed at the sheet discharging port 35 of the sheet introducing path 28 and the processing tray 37 is arranged therebelow. The first sheet discharging path (switchback path) 31 which guides a sheet from the sheet discharging port 35 as reversing a conveying direction is formed between the sheet discharging port 35 and the processing tray 37.

A sheet introducing mechanism which introduces a sheet from the sheet discharging port 35 onto the processing tray 37 is arranged between the sheet discharging port 35 and the processing tray 37. A positioning mechanism which positions sheets at a predetermined binding position and a sheet bundle discharging mechanism which discharges a bound sheet bundle to the first tray 49 at the downstream side are arranged at the processing tray 37. Each configuration is described later.

Here, the processing tray 37 illustrated in FIG. 2 bridge-supports a sheet fed from the sheet discharging port 35 between the processing tray 37 and the first tray 49 at the downstream side. That is, a sheet fed from the sheet discharging port 35 is to be bridge-supported with the leading end thereof being on the upmost sheet on the first tray 49 at the downstream side and the tailing end thereof being on the processing tray 37.

[Second Processing Portion]

A second sheet discharging path (second switchback path) 32 is branched from and connected to the upstream side of the first sheet discharging path (first switchback path) 31 at the sheet introducing path 28 to guide a sheet to the second processing portion B2. At the second processing portion B2, sheets fed from the sheet introducing path 28 are collated and stacked, and then, an inward-fold processing (hereinafter, called a magazine finishing) is performed on the sheets as performing a binding process on the center part thereof. The second tray 61 is arranged at the downstream side of the second processing portion B2 to store a bookbinding-processed sheet bundle.

The second processing portion B2 includes a guide member 66 which stacks sheets into a bundle shape, a regulating stopper (in the drawing, a leading end regulating stopper) 67 which performs positioning of sheets at a predetermined position on the guide member 66, a stapling unit (center-binding stapling unit) 63 which performs a binding process at the center part of the sheets which are positioned by the regulating stopper 67, and a fold-processing mechanism (a pair of folding rollers 64 and a folding blade 65) which folds a sheet bundle at the center part after the binding process is performed.

As disclosed in Japanese Patent Application Laid-open No. 2008-184324, Japanese Patent Application Laid-open No. 2009-051644, and the like, the center-binding stapling unit 63 adopts a mechanism which performs a binding process while a sheet bundle is moved along the sheet center part (line) with the sheet bundle nipped by a head unit and an anvil unit. Further, as illustrated in FIG. 2, the fold-processing mechanism has a structure to perform folding with rolling of the pair of folding rollers 64 after a folding line part of a sheet bundle is inserted by the folding blade 65 between the pair of folding rollers 64 which are mutually press-contacted. Such a mechanism is also disclosed in Japanese Patent Application Laid-open No. 2008-184324, Japanese Patent Application Laid-open No. 2009-051644, and the like.

In the drawing, the first processing portion B1 and the sheet introducing path 28 are arranged approximately in the horizontal direction, the second sheet discharging path 32 which guides sheets to the second processing portion B2 is arranged in the vertical direction, and the guide member 66 which collates and stacks sheets is arranged approximately in the vertical direction. As described above, the sheet introducing path 28 is arranged in a direction of traversing the apparatus housing 27 and the second sheet discharging path 32 and the second processing portion B2 are arranged in the vertical direction, so that the apparatus can be slimmed.

The second tray 61 is arranged at the downstream side of the second processing portion B2 to store a sheet bundle which is folded into a magazine shape. In the drawing, the second tray 61 is arranged below the first tray 49. In view of that a frequency in use of the first tray 49 is higher than a frequency in use of the second tray 61, the first tray 49 is arranged at a height position at which sheets are easily taken out from the first tray 49.

[Third Processing Portion]

The third sheet discharging path 30 is arranged at the sheet introducing path 28 at the upstream side of the first sheet discharging path 31 and the second sheet discharging path 32, so that a sheet is guided from the introducing port 26 to the third tray 71. Further, a roller shifting mechanism (not illustrated) which offsets a fed sheet by a predetermined amount in a perpendicular direction is arranged at the path (the sheet introducing path 28 or the third sheet discharging path 30) for guiding the sheet from the introducing port 26 to the third tray 71.

Then, sheets are stored onto the third tray 71 while the sheets to be discharged from the introducing port 26 to the third tray 71 are shifted (offset) in the perpendicular direction so that the sheets are sorted for each bundle. Since a variety of mechanisms are known as such a jog sorting mechanism, description thereof is skipped.

[Structure of First Processing Portion]

Description is provided on the respective structures of a sheet introducing mechanism, a sheet positioning mechanism, a binding processing mechanism, and the sheet bundle discharging mechanism of the first processing portion B1.

[Sheet Introducing Mechanism]

Figure 3:
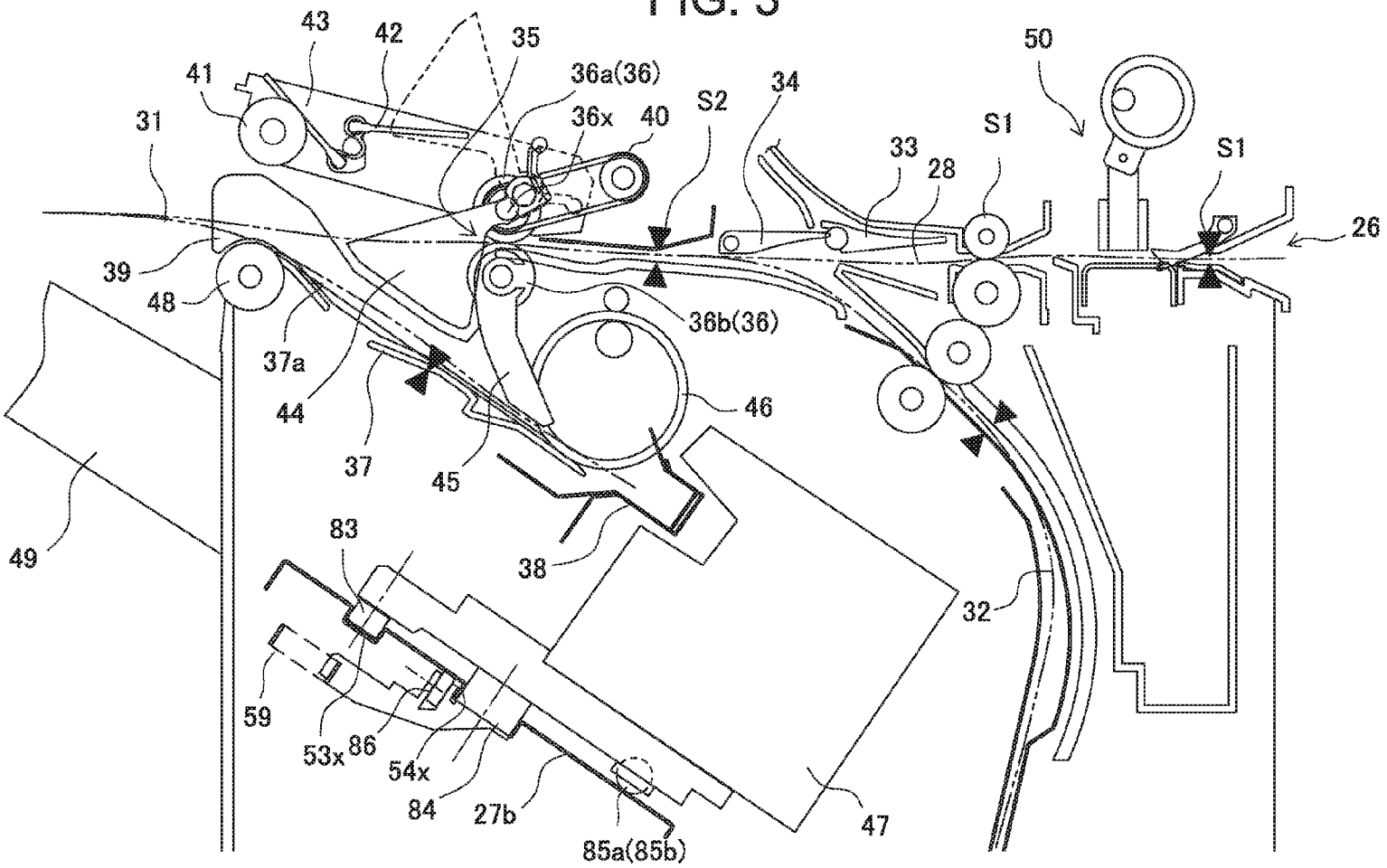
FIG. 3 is an enlarged view of a main part of a path in the apparatus of FIG. 2.

As illustrated in FIG. 3, a reverse conveying mechanism 41, 42 which performs switchback conveying on a sheet from the sheet discharging port 35 in an opposite direction to the sheet discharging direction, a guiding mechanism (sheet guiding member) 44 which guides a sheet to the tray side, and a raking rotor 46 which guides a sheet to a leading end regulating device are arranged between the sheet discharging port 35 and the processing tray 37.

The reverse conveying mechanism includes a lifting-lowering roller 41 which is moved upward and downward between an operating position to be engaged with a sheet to be introduced onto the processing tray 37 and a waiting position to be separated therefrom, and a paddle rotor 42 which conveys a sheet in the direction opposite to the sheet discharging direction. The lifting-lowering roller 41 and the paddle rotor 42 are attached to a swing bracket 43.

The swing bracket 43 is arranged at the apparatus frame 70 swingably about a rotating shaft 36x (in the drawing, a sheet discharging roller shaft). A rotating shaft of the lifting-lowering roller 41 and a rotating shaft of the paddle rotor 42 are bearing-supported by the swing bracket 43. A lifting-lowering motor (not illustrated) is connected to the swing bracket 43, so that the lifting-lowering roller 41 and the paddle rotor 42 which are mounted thereon are moved upward and downward between the operating position to be engaged with a sheet and the waiting position to be separated therefrom.

Further, a drive motor (not illustrated) is connected to each of the lifting-lowering roller 41 and the paddle rotor 42 to transmit driving so that the lifting-lowering roller 41 is rotated in forward and reverse directions and the paddle rotor 42 is rotated in a reverse direction (a direction opposite to the sheet discharging direction). Further, a driven roller 48 which is mutually pressure-contacted to the lifting-lowering roller 41 is arranged at the processing tray 37, so that a sheet or bundle-shaped sheets is nipped and conveyed to the downstream side.

The guiding mechanism which guides a tailing end of a sheet introduced onto the processing tray 37 toward a regulating device 38 is arranged between the lifting-lowering roller 41 and the later-described raking rotor 46. As illustrated in FIG. 3, the guiding mechanism is structured with the sheet guiding member 44 which is moved upward and downward between a state illustrated in a dotted line and a state illustrated in a solid line. The sheet guiding member 44 retracts to the dotted-line position when a sheet is discharged from the sheet discharging port 35. After a tailing end of the sheet passes through the sheet discharging port 35, the sheet guiding member 44 guides the sheet tailing end onto the processing tray 37. A driving mechanism (not illustrated) is connected to the sheet guiding member 44, so that the sheet guiding member 44 is moved upward and downward in accordance with timing of guiding the sheet tailing end from the sheet discharging port 35 onto the processing tray 37.

[Sheet Positioning Mechanism]

The positioning mechanism 38, 39 which positions sheets at a predetermined binding position is arranged at the processing tray 37. As illustrated in the drawing, the positioning mechanism is structured with a sheet end regulating device 38 which performs regulation with abutting against a sheet tailing end and a side edge aligning device 39 which positions a sheet side edge at a reference position (center reference, side reference).

As illustrated in FIG. 3, the sheet end regulating device 38 is structured with a stopper member which performs regulation with abutting against a sheet tailing end. The side edge aligning member 39 is described later with reference to FIG. 5. In the illustrated apparatus, a sheet is discharged from the sheet introducing path 28 in center reference. Then, in accordance with a binding mode, the sheet is positioned in center reference as well or side reference.

[Side Edge Aligning Device]

Figure 5:
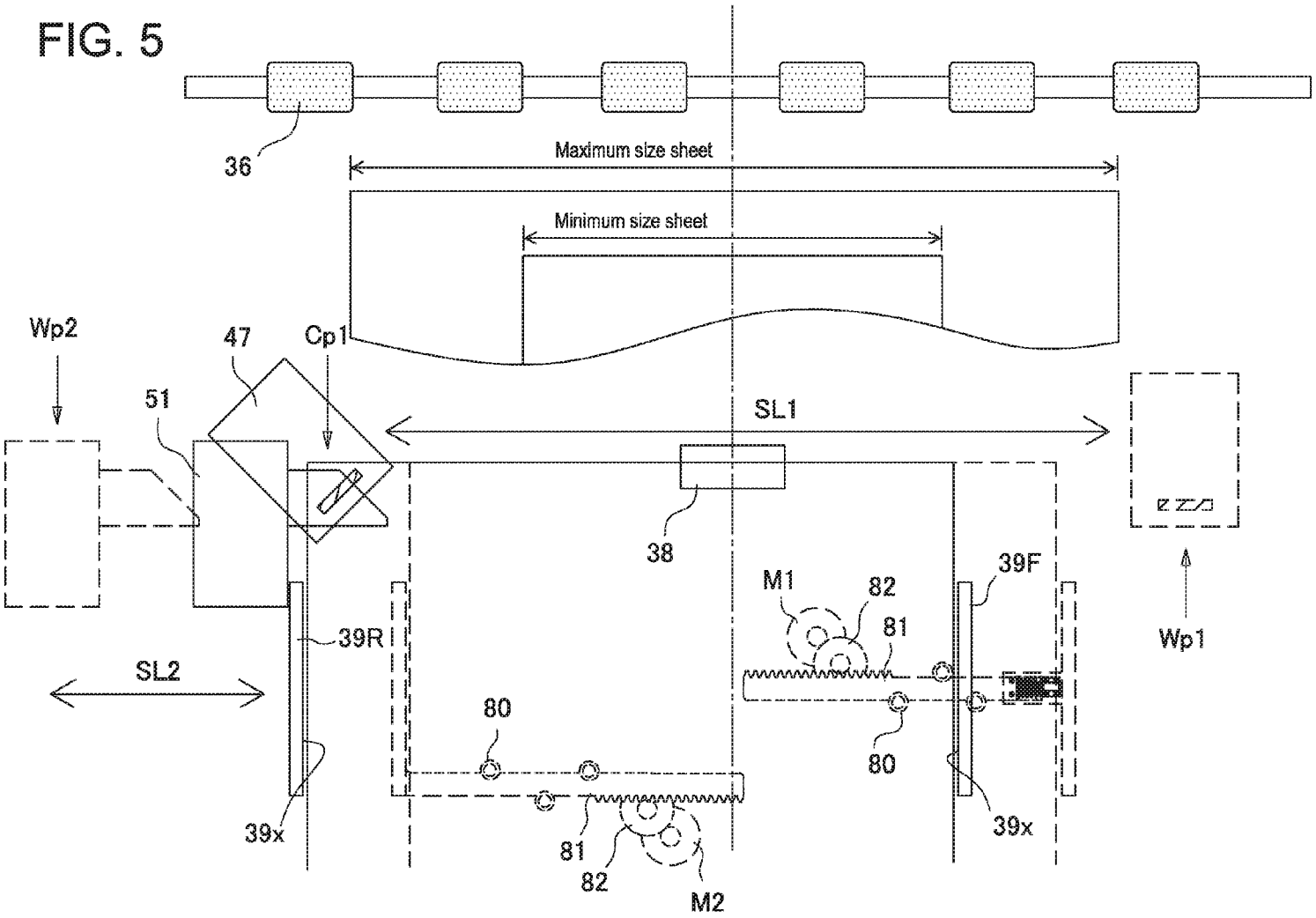
FIG. 5 is an explanatory view illustrating an arrangement relation among alignment positions and the stapling unit in the apparatus of FIG. 2.

As illustrated in FIG. 5, side edge aligning plates 39F, 39R are protruded upward from the sheet placement face 37*a* of the processing tray 37 and arranged as a right-left pair to be mutually opposed, each having a regulating face 39*x* which is engaged with a side edge of a sheet. The pair of side edge aligning devices 39 are arranged at the processing tray 37 to be capable of reciprocating by a predetermined stroke. The stroke is set in accordance with a size difference between a maximum size sheet and a minimum size sheet and an offset amount of rightward or leftward moving (offset conveying) of an aligned sheet bundle.

That is, the movement stroke of the right-left side edge aligning devices 39F, 39R is set in accordance with a movement amount for aligning different size sheets and the offset amount of the aligned sheet bundle. As offset movement of the side edge aligning plates 39F, 39R, a sheet discharged in center reference is moved by a predetermined amount rightward for right corner binding and leftward for left corner binding. The offset movement is performed one by one (for each introduced sheet) each time when a sheet is introduced to the processing tray 37 or performed for each bundle to be bound after sheets are aligned in a bundle shape.

As illustrated in FIG. 5, the side edge aligning device 39 is structured with the right side edge aligning member 39F (apparatus front side) and the left side edge aligning member 39R (apparatus rear side). Both the side edge aligning members are supported by the processing tray 37 so that the regulating faces 39*x* which are engaged with side edges of a sheet are mutually moved in a closing direction or a separating direction. Slit grooves (not illustrated) are formed to penetrate the processing tray 37. The side edge aligning devices 39 each having the regulating face 39*x* which is engaged with a sheet side edge are fitted to the slits toward the upper face of the processing tray 37 in a slidable manner.

The respective side edge aligning members 39F, 39R are slidably supported at the back face of the processing tray 37 with a plurality of guide rollers 80 (or may be a rail member) and a rack 81 is integrally arranged at each of the side edge aligning members 39F, 39R. Aligning motors M1, M2 are connected to the right-left racks 81 respectively via a pinion 82. The right-left aligning motors M1, M2 are structured with stepping motors. Here, positions of the right-left side edge aligning members 39F, 39R are detected by a position sensor (not illustrated). The respective side edge aligning members 39F, 39R are structured to be capable of being moved by a specified movement amount in both right and left directions with reference to the detection values.

Here, without adopting the illustrated rack-and-pinion mechanism, it is also possible to adopt a structure that the side edge aligning members 39F, 39R are fixed to a timing belt which is connected via a pulley to a motor for causing the timing belt to reciprocate to the right and left.

With the abovementioned structure, the later-described controller 95 causes the right-left side edge aligning members 39F, 39R to wait at predetermined waiting positions (positions to be mutually apart by a sheet width+$\alpha$) based on sheet size information provided from the image forming apparatus A and the like. In multi-binding operation, the aligning operation is started at timing when a tailing end of a sheet is abutted to the tailing end regulating device 38 after the sheet is introduced onto the processing tray 37. In the aligning operation, the right-left aligning motors M1, M2 are rotated in opposite directions (closing directions) by the same amount.

Sheets introduced onto the processing tray 37 are positioned with reference to the sheet center and stacked into a bundle shape. According to repetition of the introducing operation and the aligning operation of sheets, the sheets are collated and stacked into a bundle shape on the processing tray 37. Here, a sheet having a different size is positioned in center reference as well. In corner binding operation, the aligning operation is started at timing when a tailing end of a sheet is abutted to the tailing end regulating device 38 after the sheet is introduced onto the processing tray 37. In the aligning operation, a movement amount of the aligning plate at the binding position side is set different from a movement amount of the aligning plate at the side opposite to the binding position. The movement amounts are set so that the sheet corner is located at a previously-set binding position.

[Binding Processing Mechanism]

Binding processing mechanisms 47, 51 which perform a binding process on a sheet bundle stacked on the sheet placement face 37*a* are arranged at the processing tray 37. Sheets are positioned at a predetermined binding position on the sheet placement face 37*a* of the processing tray 37 by the positioning mechanism (the sheet end regulating device 38 and the side edge aligning device 39). The binding processing mechanisms 47, 51 are structured so that a first binding unit 47 (a first binding device being the stapling unit, as the case may be) which performs a staple binding using a staple on a sheet bundle and a second binding unit 51 (a second binding device being an eco-binding unit, as the case may be) which performs a non-staple binding are arranged contrary at the binding position.

As illustrated in FIG. 2, the binding processing mechanisms 47, 51 which perform a binding process on a tailing end of sheets introduced from the sheet discharging port 35 are arranged at the processing tray 37. The binding processing mechanisms include the stapling unit (first binding unit) 47 capable of being moved along the tailing end of the sheet placement face 37*a* of the processing tray 37 and the eco-binding unit (second binding unit) 51, as illustrated in FIG. 4.

Figure 4:
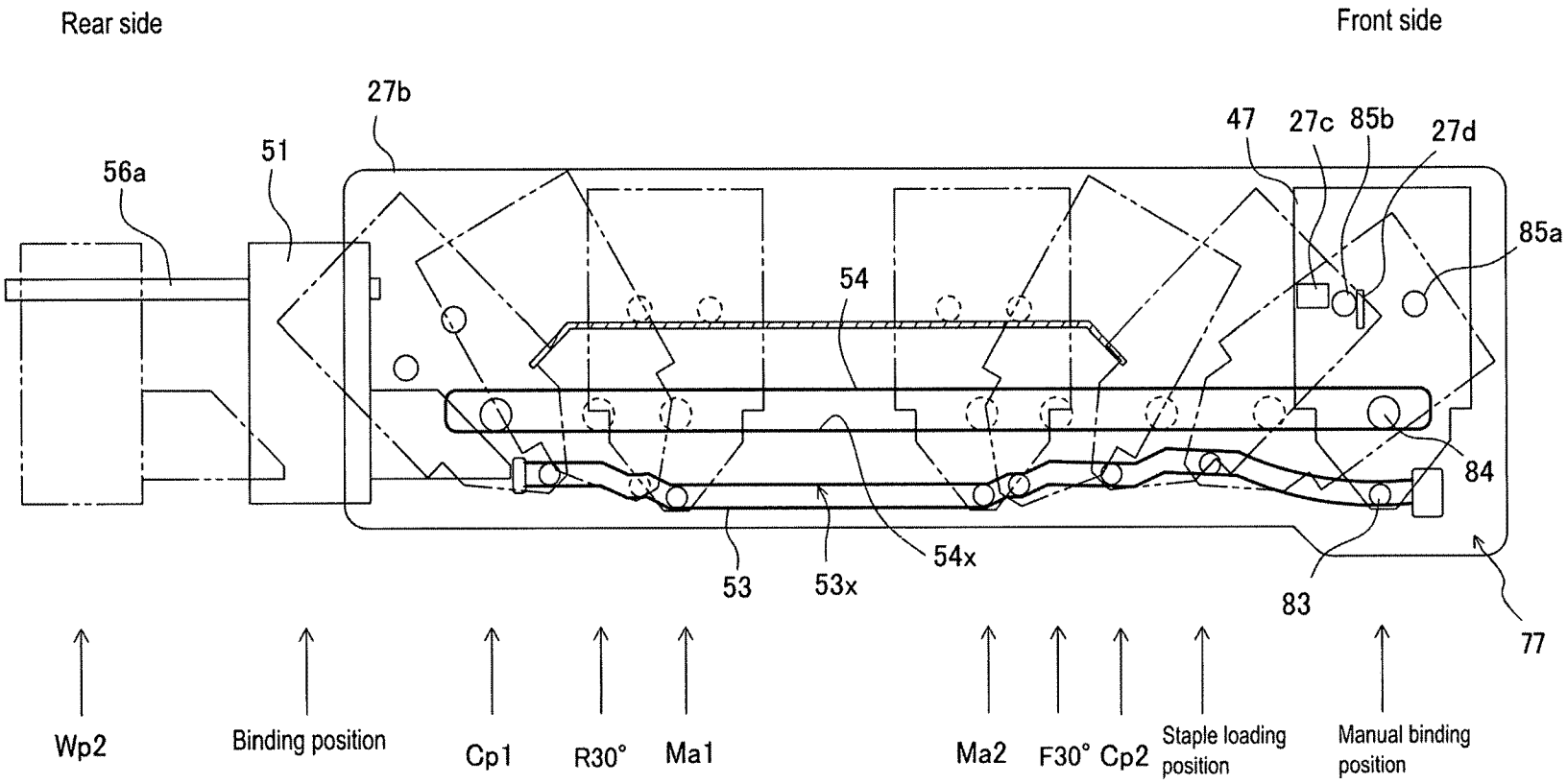
FIG. 4 illustrates a movement trajectory of a stapling unit and an eco-binding device.

FIG. 4 illustrates the stapling unit (first binding unit) 47 and the eco-binding unit (second binding unit) 51 which are arranged at the processing tray 37. In the illustrated apparatus, a binding position Cp1 is set at a sheet corner located at the upper-left side in the drawing. The first binding unit 47 and the second binding unit 51 are moved contrary to the binding position Cp1.

The first binding unit 47 is moved by a predetermined stroke SL1 along the first travel rail 53 and a second travel rail 54 which are formed at the apparatus frame 27*b* along one sheet end. Similarly, the second binding unit 51 is moved by a predetermined stroke SL2 along a first guide rod 56*a* and a second guide rod 56*b* (see FIG. 10) which are arranged at the apparatus frame 57 along one sheet end.

FIG. 5 illustrates a sheet introduced onto the processing tray 37 and movement strokes of the first and second binding units 47, 51. Sheets having different sizes (between the maximum size sheet and the minimum size sheet) are introduced onto the processing tray 37 in center reference. The sheet is aligned by the right-left pair of side edge aligning members 39F, 39R (so that sheets having different sizes are matched) with reference to a sheet side edge at the binding side (left side edge in FIG. 9). The right-left aligning members 39F, 39R are connected re spectively to the separate drive motors M1, M2. The later-described controller 95 sets movement amount of the right-left aligning members 39F, 39R in accordance with sheet sizes.

In a binding process other than the corner binding process, for example, in a later-described multi-binding process, the later-described controller 95 causes sheets to be aligned in center reference. In this case, the sheets are positioned at the binding position owing to that the right-left aligning members 39F, 39R are moved toward the sheet center from the waiting positions by respectively the same amount.

Figure 15:
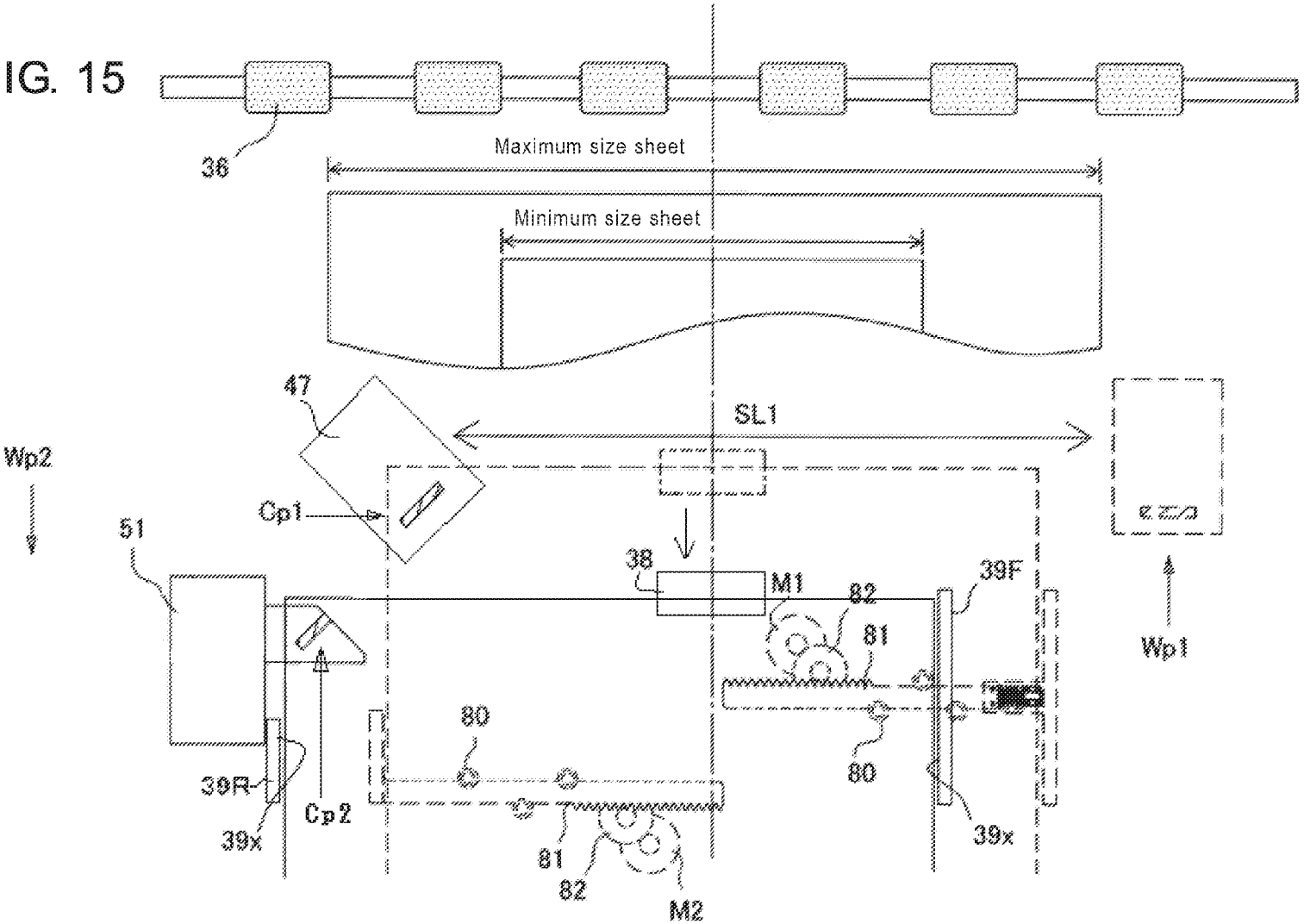
FIG. 15 is an explanatory view illustrating a first arrangement relation between the binding device in the apparatus of FIG. 2 and sheet positions.

In the following, description is provided with reference to FIG. 5. The first binding unit 47 is moved by the first stroke SL1 between a waiting position Wp1 (first waiting position) and the binding position Cp1. The second binding unit 51 is moved by the second stroke SL2 between awaiting position Wp2 (second waiting position) and the binding position Cp1. That is, the first binding unit 47 is caused to reciprocate between the first waiting position Wp1 and the binding position Cp1 along the travel rails 53, 54 (guide grooves, guide rods, or the like) and the second binding unit 51 is caused to reciprocate between the second waiting position Wp2 and the binding position Cp1 along guide rods 56*a*, 56*b* (or may be guide grooves). Alternatively, as illustrated in FIG. 15, it is also possible to move sheets with the sheet positioning mechanism 38, 39 between the first binding position Cp1 and a second binding position Cp2 (being different from Cp1) of the second binding unit 51.

Here, the binding position Cp1 is set at a sheet corner (hereinafter, called a set binding position). The first waiting position Wp1 and the second waiting position Wp2 satisfy following relations with the set binding position Cp1.

(1) The first waiting position Wp1 and the second waiting position Wp2 are located at opposite sides as sandwiching the set binding position Cp1.
(2) The first waiting position Wp1 is set at the outer side of the maximum size sheet on which a binding process is to be performed on the processing tray 37 or a binding processing position being farthest from the set binding position Cp1 on the processing tray 37 (a later-described multi-binding position Ma or the manual binding position Mp; the farthest binding position).
(3) The second waiting position Wp2 is set at the outer side of the sheet side edge aligned at the set binding position (outside a sheet placement area of the sheet placement face).
(4) The first stroke SL1 between the first waiting position Wp1 and the set binding position Cp1 is set larger (longer) than the second stroke SL2 between the second waiting position Wp2 and the set binding position Cp1.

Owing to that the first waiting position Wp1 and the second waiting position Wp2 are set at opposite sides with respect to the set binding position Cp1 as described above, it is possible that one unit is moved in a separating direction while the other unit is moved in a closing direction (a contrary retracting-closing operation). Further, owing to that the first stroke SL1 is set larger than the second stroke SL2, the binding processing position (the later-described multi-binding position Ma) of the first binding unit 47 can be set relatively freely. In contrast, the second binding unit 51 performs a binding process only at a previously-set binding position. According to the above, the length of the total movement stroke of the first and second binding units 47, 51 can be set small and the apparatus can be miniaturized.

Further, the later-described controller 95 may move the first and second binding units 47, 51 in a contrary manner so that the second binding unit 51 is located at the waiting position Wp2 when the first binding unit 47 is at the set binding position Cp1 and the first binding unit 47 is located at the waiting position Wp1 when the second binding unit 51 is at the set binding position Cp1. To further improve the efficiency, the controller 95 may locate the first binding unit 47 having a wide opening portion, for example, at Wp3 (see FIG. 16) not at the waiting position Wp1 when the second binding unit 51 having a narrow opening portion is at the set binding position Cp1, while the second binding unit 51 having the narrow opening portion is located at the waiting position Wp2 when the first binding unit 47 having the wide opening portion is at the set binding position Cp1.

Further, it is also possible that the second binding unit 51 is arranged at the binding position Cp2 to be capable of performing a binding process and the controller 95 causes sheets to be positioned by the positioning mechanisms 38, 39 selectively between the binding positions Cp1, Cp2.

Figure 16:
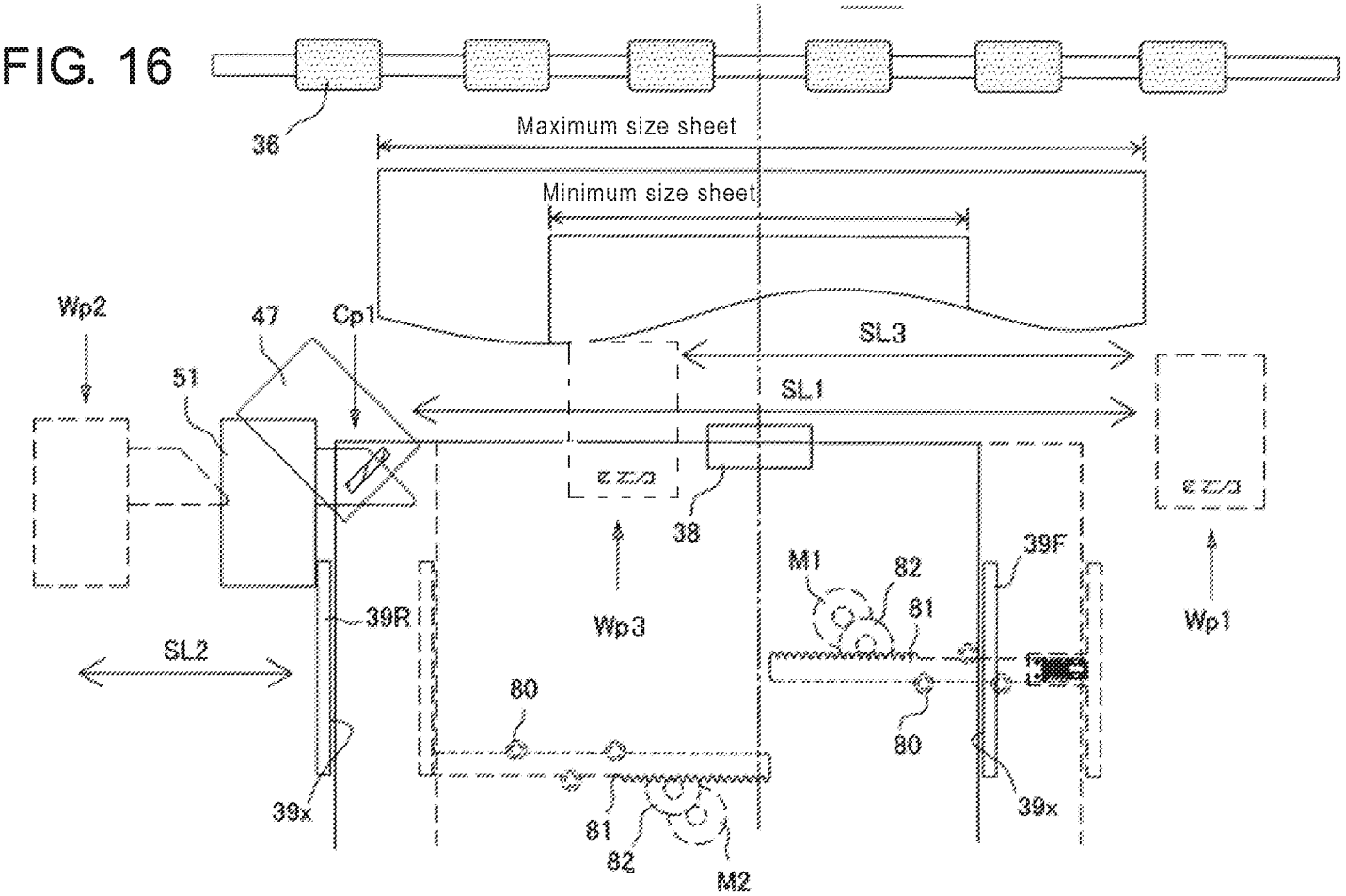
FIG. 16 is an explanatory view illustrating a second arrangement relation between the binding device in the apparatus of FIG. 2 and sheet positions.

Here, when sheets are to be bound by one binding unit, the other binding unit may be located at the outside (outer side) of a sheet introduction area of the sheets introduced onto the processing tray 37 (the sheets to be bound by the one binding unit), that is, at the outside of the sheets on the processing tray 37 (in a state that the sheets to be bound by the one binding unit is not advanced into the opening portion of the other binding unit). As illustrated in FIG. 16, when the second binding unit 51 having the low binding processing capacity performs a binding process, the first binding unit 47 having the high binding processing capacity may be located at the inside (inner side) of the sheet introduction area of sheets introduced onto the processing tray 37 (sheets to be bound by the second binding unit), that is, at the inside of sheets on the processing tray 37 (in a state that the sheets to be bound by the second binding unit is advanced into the opening portion of the first binding unit).

According to the structure described above, a sheet bundle is prevented from being disarranged in posture to be caused by interference of the sheet bundle with the opening portion of the second binding unit 51 when the first binding unit 47 performs a binding process thereon. Further, the number of sheets on which a binding process is to be performed by the first binding unit 47 is not limited by the binding processing capacity of the second binding unit 51 having the low binding processing capacity.

The contrary movement of the first and second binding units 47, 51 is performed with a method of (1) differentiating rotational amounts in accordance with movement strokes with separate drive motors, or (2) differentiating movement amounts between the first binding unit 47 and the second binding unit 51 with the same drive source.

Figure 6:
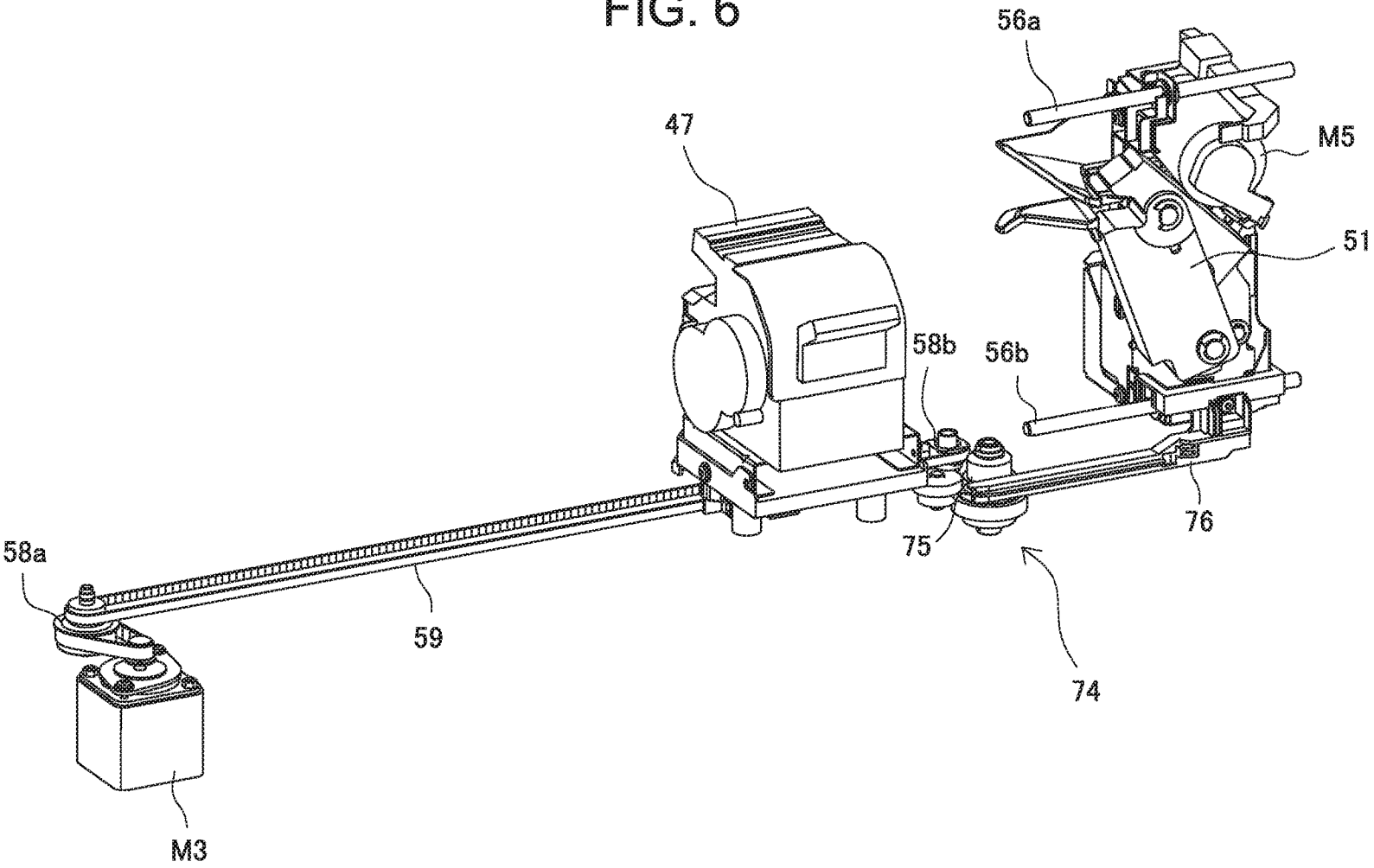
FIG. 6 is a view illustrating a slide mechanism for the binding device.

FIG. 6 illustrates an embodiment to differentiate movement amounts of the first binding unit 47 and the second binding unit 51 with the same drive source. A right-left pair of pulleys 58*a*, 58*b* are arranged at the apparatus frame 27*b* along a movement area of the first binding unit 47 (in the right-left direction in FIG. 6). A timing belt (toothed belt) 59 is routed between the pulleys 58*a*, 58*b* and a drive motor M3 (stepping motor) is connected to one pulley 58*a*.

A transmitting pinion 75 is connected to the other pulley 58*b* via a differential device (transmitting device) 74. A rack 76 which is fixed to a frame of the second binding unit 51 is engaged with the transmitting pinion 75. The differential device 74 is structured with a gear mechanism (a first embodiment described below), a slide clutch mechanism (a second embodiment described below), or the combination of both the mechanisms having a transfer ratio matched to the difference between the first and second strokes SL1, SL2.

[First Embodiment of Differential Device]

Figure 7A:
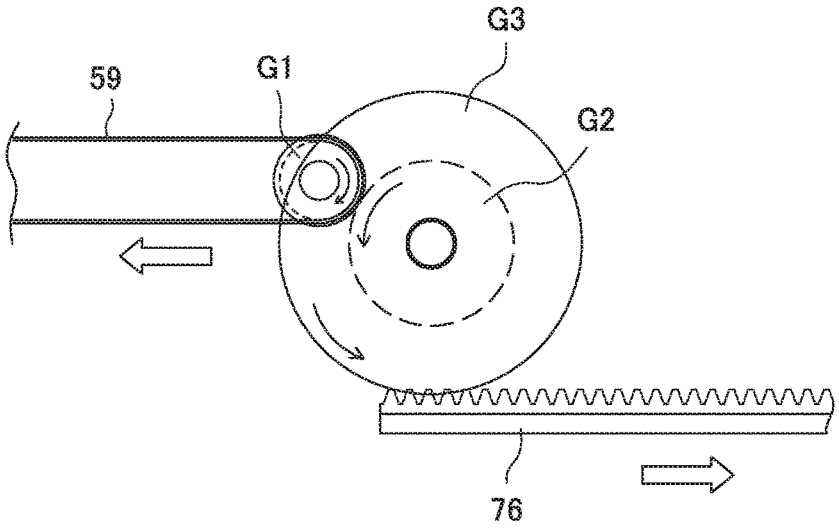
FIGS. 7A and 7B are explanatory views of a first embodiment of a differential device in the apparatus of FIG. 2.

FIG. 7 illustrates the first embodiment of the differential device 74. Here, when the drive motor M3 is rotated by a predetermined rotational amount in the transmitting mechanism (the perspective structure of which is illustrated in FIG. 6), the first binding unit 47 is linearly moved in a reciprocating manner by the first stroke SL1 and the second binding unit 51 is linearly moved in a reciprocating manner by the second stroke SL2 with the rotational amount, so that the transfer rate is differentiated.

Figure 7B:
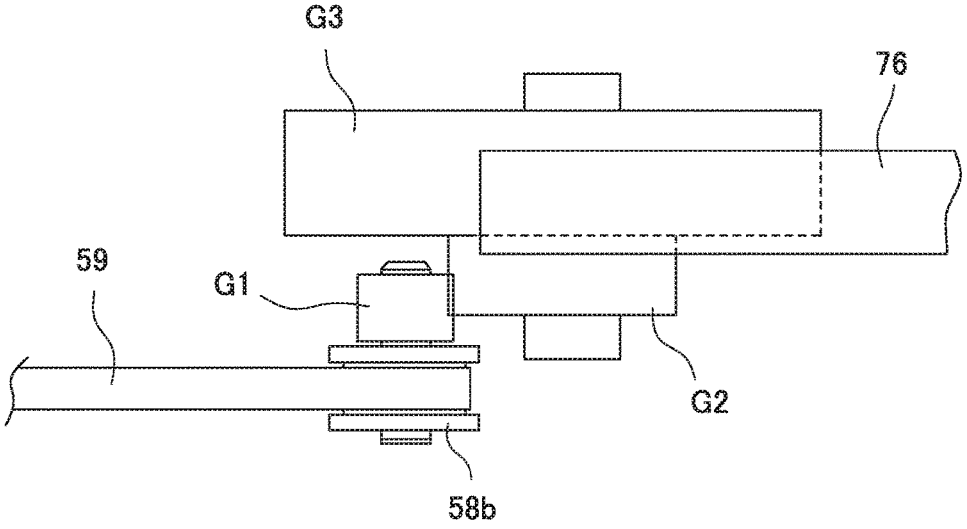

For example, in the illustrated apparatus, to obtain a relation that the second stroke SL2 is set to one-fifth of the first stroke SL1, the number ratio of teeth of a gear G1 connected to the drive motor M3 is set to five times larger than the number ratio of teeth of a gear G3 engaged with the rack 76 via a gear G2. In FIG. 7B, the transmitting gear G1 is arranged at the pulley (driven pulley) 58*b* which is connected to the drive motor M3. The gear G2 driven by the transmitting gear G1 is connected to the gear G3 engaged with the rack 76 so as to be rotated coaxially and integrally. The number ratio of teeth of the gear G1 and the gears G2, G3 is set to be matched with the stroke ratio of the first and second strokes SL1, SL2.

Thus, when the drive motor M3 is rotated by the predetermined amount, the first binding unit 47 is moved by the first stroke SL1, and at the same time, the second binding unit 51 is moved by the second stroke SL2. The respective movements are set in the same direction.

[Second Embodiment of Differential Device]

As illustrated as the perspective structure in FIG. 6, the timing belt 59 for the first binding unit 47 is connected to the drive motor M3. As described above, the movement stroke SL1 of the first binding unit 47 is set longer than the movement stroke SL2 of the second binding unit 51. In a differential device 77 illustrated in FIG. 8, a slide clutch device 78 is arranged at a transmitting device for the second binding unit 51 which has a short movement distance.

Figure 8A:
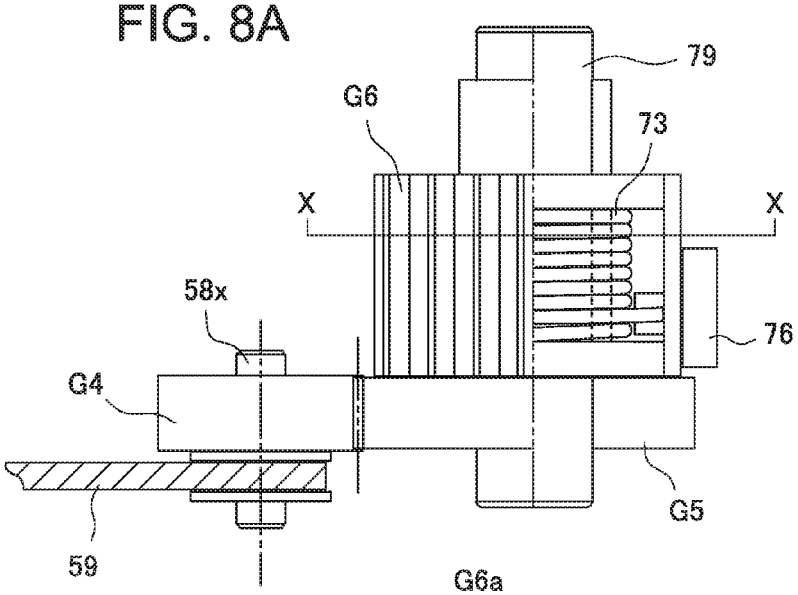
FIGS. 8A-8D are explanatory views of a second embodiment of the differential device in the apparatus of FIG. 2.

FIG. 8A illustrates an example of a slide clutch mechanism. A transmitting gear G4 is arranged integrally with a pulley shaft 58*x* for the timing belt 59 which is connected to the drive motor M3 to move the first binding unit 47 in a reciprocating manner. A gear G5 engaged with the gear G4 is arranged integrally with a transmitting rotary shaft 79. Further, a transmitting pinion G6 is loosely fitted to an outer circumference of the transmitting rotary shaft 79 in a rotatable manner. The rack 76 fixed to the second binding unit 51 is connected to the transmitting pinion G6 as being engaged therewith.

A clutch spring 73 is arranged between the transmitting rotary shaft 79 which is connected to the drive motor M3 and the transmitting pinion G6 which is loosely fitted to the transmitting rotary shaft 79 so as to generate sliding motion between the transmitting rotary shaft 79 and the transmitting pinion G6 when a load torque transmitted to the transmitting pinion G6 exceeds a predetermined value.

Figure 8B:
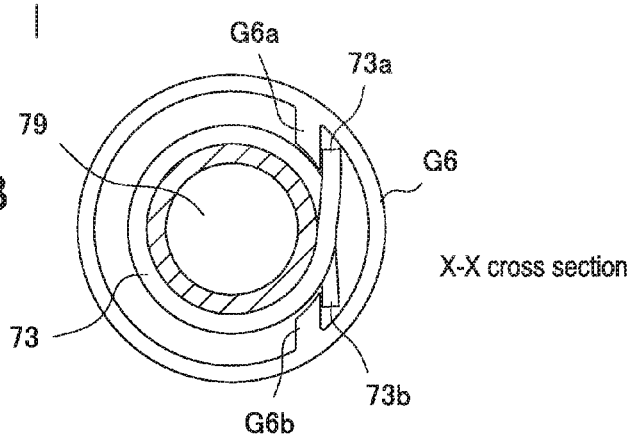
Figure 8C:
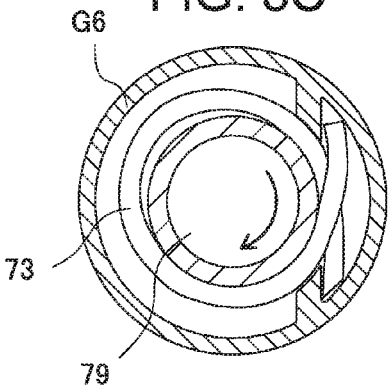
Figure 8D:
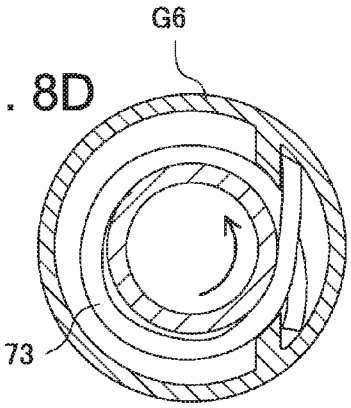

As illustrated in FIGS. 8B, 8C, and 8D, free ends 73*a*, 73*b* of the clutch spring 73 are engaged with protrusions G6*a*, G6*b* which are arranged at the transmitting pinion G6 side. The clutch spring 73 and the transmitting rotary shaft 79 are frictionally engaged with each other. Owing to the frictional relation, when the load torque of the transmitting pinion G6 exceeds the predetermined value, the clutch spring 73 is released to generate a slip between the transmitting rotary shaft 79 and the transmitting pinion G6. When the load torque is equal to or smaller than the predetermined value, rotating is transmitted in a state of FIG. 8B. Further, when the load torque exerted on the second binding unit 51 exceeds the predetermined value, a slip occurs between the transmitting rotary shaft 79 and the transmitting pinion G6 with rotation in a direction of an arrow in FIGS. 8C and 8D.

With the structure described above, when the first binding unit 47 is moved with rotation of the drive motor M3 from the set binding position Cp1 to the waiting position Wp1, the clutch spring 73 in the state of FIG. 8B is interlocked with the second binding unit 51 to move the second binding unit 51 from the waiting position Wp2 toward the set binding position Cp1. When the second binding unit 51 arrives at the set binding position Cp1 and is abutted to an engaging stopper (not illustrated), a load torque having an almost-infinite value is exerted to the transmitting pinion G6. Owing to excess of the load torque, a gap is formed between the clutch spring 73 and the transmitting rotary shaft 79 to generate the sliding motion. Then, subsequent rotation of the drive motor M3 moves the first binding unit 47 toward the waiting position Wp1.

Similarly, the transmitting rotation and the sliding rotation due to the clutch spring 73 occur in series also when the first binding unit 47 is moved from the waiting position Wp1 to the set binding position Cp1 (rotation reverse to motor rotation). Thus, the first binding unit 47 reciprocates in the first stroke SL1 with forward-reverse rotation of the drive motor M3. During the initial stage of the movement, the second binding unit 51 reciprocates along therewith in the second stroke SL2. Thereafter, rotation of the drive motor M3 is transmitted only to the first binding unit 47.

[Moving Mechanism of Stapling Unit]

As illustrated in FIG. 3, the stapling unit 47 is mounted on the apparatus frame (chassis frame) 27*b* movably by a predetermined stroke. The first travel rail 53 and the second travel rail 54 are arranged at the apparatus frame 27*b*. A travel rail face 53*x* is formed at the first travel rail 53 and a travel cam face 54*x* is formed at the second travel rail 54. The travel rail face 53*x* and the travel cam face 54*x* in mutual cooperation support the stapling unit 47 (hereinafter in this section, called a moving unit) to be capable of reciprocating by a predetermined stroke and control an angular posture thereof.

The first travel rail 53 and the second travel rail 54 are formed so that the travel rail face 53*x* and the travel cam face 54*x* allow the moving unit to reciprocate within a movement range of the moving unit (see FIG. 4). The timing belt 59 which is connected to the drive motor M3 is fixed to the moving unit (stapling unit) 47. The timing belt 59 is wound to the pair of pulleys 58*a*, 58*b* which are axially-supported by the apparatus frame 27*b* and the drive motor M3 is connected to one pulley. According to the above, the stapling unit 47 reciprocates by the stroke SL1 with forward and reverse rotation of the drive motor M3.

The travel rail face 53*x* and the travel cam face 54*x* are arranged to include parallel distance sections (having a span I1) where the faces are in parallel, narrow slant distance sections (having a span I2), and a narrower slant distance section (having a span I3). Here, the spans satisfy the relation of "I1>I2>I3". The span I1 causes the stapling unit to be in a posture as being in parallel to a sheet tailing end edge. The span I2 causes the stapling unit to be in a slant posture rightward or leftward. The span I3 causes the stapling unit to be in a posture slant at a larger angle. Thus, the slant angle of the stapling unit is varied.

The moving unit 47 is engaged with the first and second travel rails 53, 54 as described below. As illustrated in FIG. 3, the moving unit 47 is provided with a first rolling roller (rail fitting member) 83 which is engaged with the travel rail face 53*x* and a second rolling roller (cam follower member) 84 which is engaged with the travel cam face 54*x*. Further, the moving unit 47 is provided with a slide roller 85 (in the drawing, ball-shaped sliding rollers 85*a*, 85*b* at two positions) which is engaged with a support face of the frame 27*b*. Further, a guide roller 86 which is engaged with a bottom face of a bottom frame is formed at the moving unit 47 to prevent the moving unit 47 from floating from the bottom frame 27*b*.

According to the above structure, the moving unit 47 is supported by the bottom frame 27*b* movably via the sliding roller 85 and the guide rollers 86. Further, the first rolling roller 83 and the second rolling roller 84 are rotated and moved along the travel rail face 53*x* and the travel cam face

54*x* respectively as following the travel rail face 53*x* and the travel cam face 54*x* respectively.

The travel rail face 53*x* and the travel cam face 54*x* are arranged so that the parallel distance sections (having the span I1) are arranged at the multi-binding positions Ma1, Ma2 and the manual binding position Mp. With the span I1, the moving unit 47 is maintained in a posture as being perpendicular to a sheet end edge without being slant, as illustrated in FIG. 4. Accordingly, at the multi-binding positions Ma1, Ma2 and the manual binding position Mp, a sheet bundle is bound with a staple being parallel to a sheet end edge.

Further, the travel rail face 53*x* and the travel cam face 54*x* are arranged so that the slant distance sections (having the span I2) are arranged at the right corner binding position Cp2 and the left corner binding position Cp1. The moving unit 47 is maintained in a rightward-angled posture (e.g., rightward-angled by 45 degrees) or in a leftward-angled posture (e.g., leftward-angled by 45 degrees), as illustrated in FIG. 4.

Further, the travel rail face 53*x* and the travel cam face 54*x* are arranged so that the slant distance section (having the span I3) is arranged at a position for staple loading. The span 13 is formed to be shorter than the span I2. In this state, the moving unit 47 is maintained in a rightward-angled posture (e.g., rightward-angled by 60 degrees) as illustrated in FIG. 4. The reason why the angular posture of the moving unit 47 is varied at the staple loading position is that the posture is matched with an angular direction in which a staple cartridge 52 is mounted thereon. Here, the angle is set in relation with an open-close cover arranged at an external casing.

For shortening a movement length in varying the angular posture of the moving unit 47 using the travel rail face 53*x* and the travel cam face 54*x*, it is preferable from a viewpoint of layout compactification to arrange a second travel cam face or a stopper cam face for angle varying in cooperation with the travel cam face 53*x*.

Next, the stopper cam face will be described with reference to FIG. 4. As illustrated in FIG. 4, stopper faces 27*c*, 27*d* to be engaged with a part of the moving unit 47 (in the drawing, the sliding roller 85) are arranged at the side frame 27*b* to vary a posture of the moving unit 47 between the right corner binding position Cp2 and the manual binding position Mp at the apparatus front side. The moving unit 47 inclined at the staple loading position is required to be corrected in inclination at the manual binding position Mp. When the angle is varied only by the travel rail face 53*x* and the travel cam face 54*x*, the movement distance becomes long.

Here, when the moving unit 47 is moved toward the manual binding position Mp in a state of being locked by the stopper face 27*c*, the moving unit 47 is returned into the original state from the inclined state. Further, when the moving unit 47 is returned to the opposite direction from the manual binding position Mp, the moving unit 47 is (forcedly) inclined to face toward the corner binding position by the stopper face 27*d*.

[Structure of Stapling Unit]

Figure 9A:
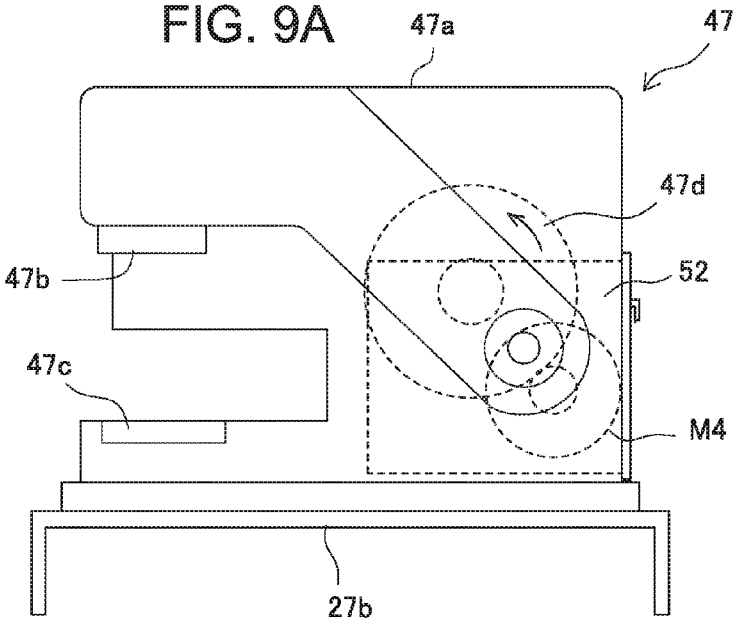
FIGS. 9A and 9B are explanatory view of a sheet bundle discharging mechanism in the apparatus of FIG. 2.

A structure of the stapling unit (first binding unit) 47 will be described with reference to FIG. 9A. The stapling unit 47 is structured as a unit separated from the sheet post-processing apparatus B. The stapling unit 47 includes a box-shaped unit frame 47*a*, a drive cam 47*d* which is swingably axially-supported by the unit frame 47*a*, and a drive motor M4 which is mounted on the unit frame 47*a* to rotate the drive cam 47*d*.

A first binding portion (stapling head) 47*b* and a second binding portion (anvil member) 47*c* which is arranged at a position distanced from the first binding portion (stapling head) 47*b* by a first predetermined distance are arranged at the binding position as being mutually opposed. The first binding portion (stapling head) 47*b* is vertically moved between a waiting position at the upper side and a stapling position at the lower side (the anvil member 26*c*) with the drive cam 47*d* and an urging spring (not illustrated). Further, the staple cartridge 52 is mounted on the unit frame 47*a* in a detachably attachable manner.

Linear blank staples are stored in the staple cartridge 52 and fed to the first binding portion (stapling head) 47*b* by a staple feeding mechanism. A former member to fold a linear staple into a U-shape and a driver to cause the folded staple to bite into a sheet bundle are built in the first binding portion (stapling head) 47*b*. With such a structure, the drive cam 47*d* is rotated by the drive motor M4 and energy is stored in the urging spring. When the rotational angle reaches a predetermined angle, the first binding portion (stapling head) 47*b* is vigorously lowered toward the second binding portion (anvil member) 47*c*. Owing to this action, a staple is caused to bite into a sheet bundle with the driver after being folded into a U-shape. Then, leading ends of the staple are folded by the second binding portion (anvil member) 47*c*, so that the staple binding is completed.

The stapling feeding mechanism is built in between the staple cartridge 52 and the first binding portion (stapling head) 47*b*. A sensor (empty sensor) to detect staple absence is arranged at the staple feeding mechanism. Further, a cartridge sensor (not illustrated) to detect whether or not the staple cartridge 52 is inserted is arranged at the unit frame 47*a*.

The illustrated staple cartridge 52 adopts a structure that belt-shaped connected staples are stacked and stored as being layered or are stored in a roll-shape in a box-shaped cartridge. Further, a circuit to control the abovementioned sensors and a circuit board to control the drive motor M4 are arranged at the unit frame 47*a* and transmit an alarm signal when the staple cartridge 52 is not mounted or the staple cartridge 52 is empty. Further, the stapling control circuit controls the drive motor M4 to perform the stapling operation with a staple signal and transmits an operation completion signal when the stapling head 47*b* is moved to an anvil position from the waiting position and returned to the waiting position.

[Structure of Non-Staple Binding Unit]

A structure of the second binding unit (non-staple binding unit) 51 will be described with reference to FIG. 9B. As a binding device to perform a binding process on a sheet bundle without using a metal staple, there have been known a device to bind sheets by pressure-nipping a sheet bundle from front and back sides with pressurizing members which have concave-convex faces to be mutually engaged (a press binding apparatus), a device to bind sheets with folding after a slit-shaped cutout is formed at the sheet bundle (a cutout fold binding apparatus; see Japanese Patent Application Laid-open No. 2011-256008), and a device to bind sheets with a plant-derived resin string (resin string binding apparatus). Since a sheet bundle is bound without using a metal staple, such a method is known as an eco-binding method. In the following, a press binding mechanism is described as an example thereof.

With a press binding mechanism, concave-convex faces are formed on both of a third binding portion (upper pressurizing face) 51*b* and a fourth binding portion (lower pressurizing face) 51*c* which is arranged at a position distanced from the third binding portion (upper pressurizing face) 51*b* by a second predetermined distance being shorter than the first predetermined distance. Here, the third and fourth binding portions 51*b*, 51*c* can be pressure-contacted and separated to each other and a sheet bundle is pressure-nipped from front and back sides, so that sheets are deformed and bound. FIG. 9B illustrates the press binding unit 51. A movable frame member 51*d* is swingably axially-supported by a base frame member 51*a* and both the frame members 51*a*, 51*d* are swung about a support shaft 51*x* as being capable of being mutually pressure-contacted and separated. A follower roller 60 is arranged at the movable frame member 51*d* and is engaged with a drive cam 68 arranged at the base frame member 51*a*.

A drive motor M5 arranged at the base frame member 51*a* is connected to the drive cam 68 via a deceleration mechanism. Rotation of the drive motor M5 causes the drive cam 68 to be rotated and the movable frame member 51*d* is swung by a cam face (eccentric cam in FIG. 9B) thereof.

The fourth binding portion (lower pressurizing face) 51*c* and the third binding portion (upper pressurizing face) 51*b* are arranged respectively at the base frame member 51*a* and the movable frame member 51*d* as being mutually opposed. An urging spring (not illustrated) is arranged between the base frame member 51*a* and the movable frame member 51*d* to urge both the binding portions (pressurizing faces) 51*c*, 51*b* respectively in a direction to be separated.

Figure 9B:
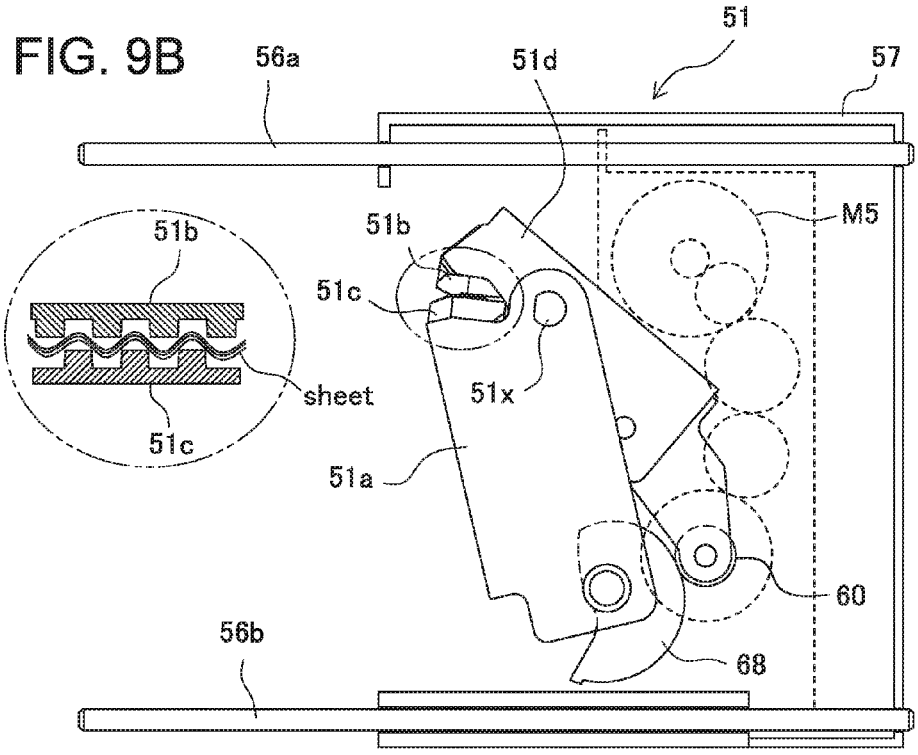

As illustrated in an enlarged view of FIG. 9B, convex stripes are formed on one of the third binding portion (upper pressurizing face) 51*b* and the fourth binding portion (lower pressurizing face) 51*c* and concave grooves to be matched therewith are formed on the other thereof. The convex stripes and the concave grooves are formed respectively into rib shapes as having predetermined length. A sheet bundle nipped between the third binding portion (upper pressurizing face) 51*b* and the fourth binding portion (lower pressurizing face) 51*c* is intimately contacted as being deformed into a corrugation shape. A position sensor (not illustrated) is arranged at the base frame member (unit frame) 51*a* and detects whether or not the third binding portion (upper pressurizing face) 51*b* and the fourth binding portion (lower pressurizing faces) 51*c* are at the pressurization positions or separated positions.

The press binding unit (the eco-binding unit, the second binding unit) 51 structured as described above is movably arranged on the first and second guide rods 56*a*, 56*b* (may be grooves as well) which are arranged at the apparatus frame 57 and reciprocates between the second waiting position Wp and the set binding position Cp1 for sheets stacked on the processing tray 37, as described above.

[Sheet Bundle Discharging Mechanism]

The sheet bundle discharging mechanism which discharges a bound sheet bundle toward the first tray 49 at the downstream side is arranged at the processing tray 37. For conveying a sheet bundle toward the downstream side, there have been known a method for conveying with a pair of rollers which are pressure-contacted to each other (a conveying roller device) and a conveying device for pushing out a sheet tailing end with a push-out member which is moved along a tray face from the upstream side to the downstream side. The illustrated apparatus adopts both the devices.

FIG. 10 illustrates the sheet bundle discharging mechanism. A conveying device is structured with a push-out projection 38 which conveys sheets along the processing tray 37 from the binding position (processing position) located at the upstream side to the stack tray (first tray) 49 at the downstream side, a conveying belt 38*v* which moves the push-out projection 38, and a drive motor M6 therefor. The driven roller 48 is arranged at a discharging port of the processing tray 37 (at the boundary between the sheet placement face 37*a* and the first tray 49). The lifting-lowering roller 41 which is pressure-contacted to the driven roller 48 is arranged in the abovementioned structure as being opposed thereto. Thus, the driven roller 48 and the lifting-lowering roller 41 structure a discharging roller device.

Figure 10A:
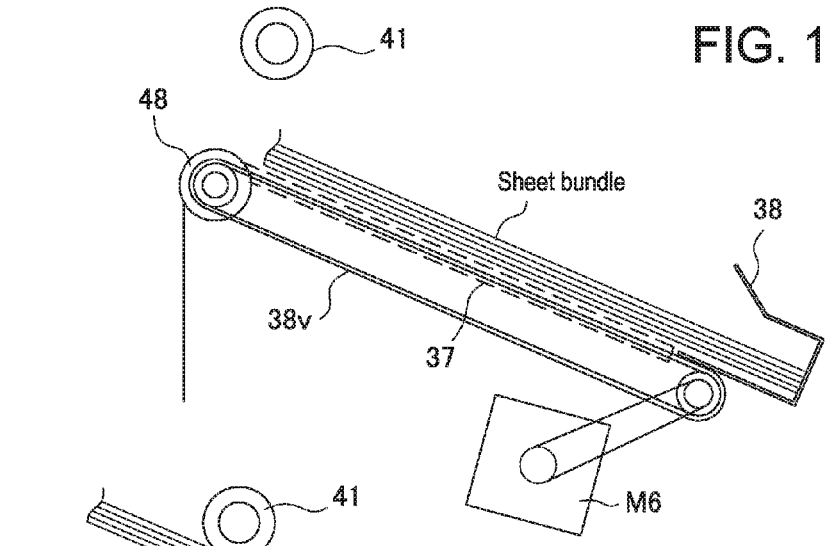
Figure 10B:
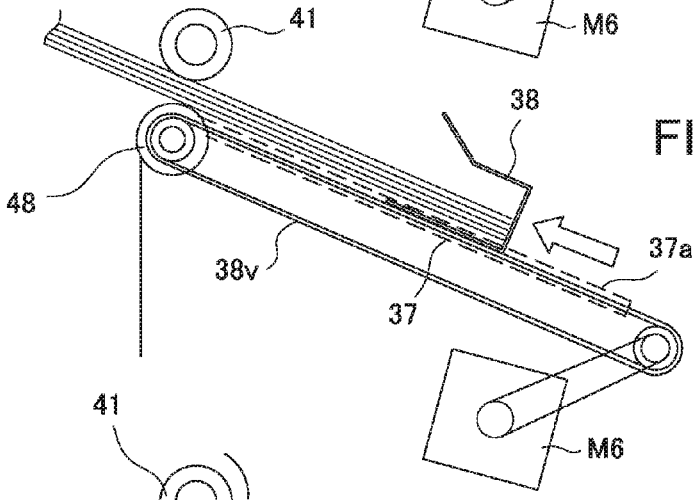
Figure 10C:
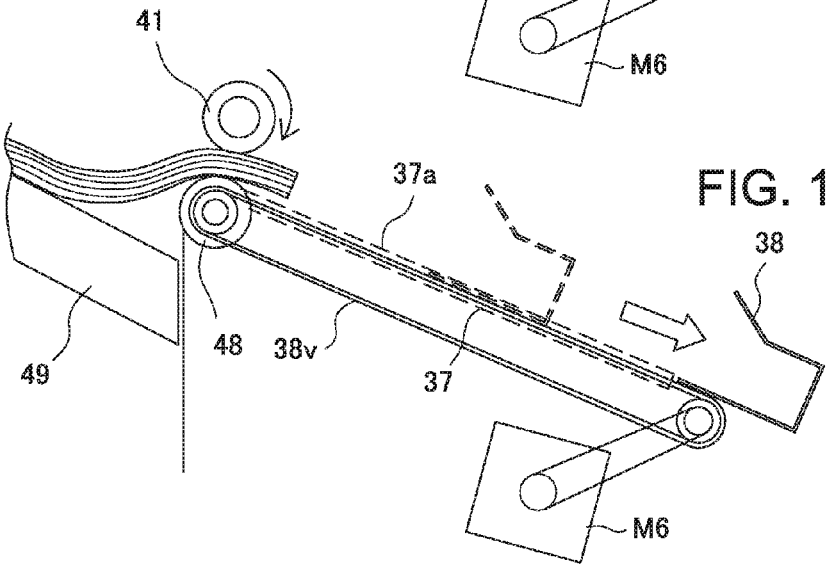

As described above, the conveying device 38, 38*v* which pushes out a sheet bundle from the upstream side to the downstream side and the discharging roller device 48, 41 which nip and discharge the sheet bundle are arranged at the processing tray 37. FIG. 10A illustrates a state that a sheet bundle is located at the binding position on the processing tray 37. At this time, the conveying device 38, 38*v* and the discharging roller device 48, 41 are in an operating state. FIG. 10B illustrates a midstream state of conveying the sheet bundle from the processing position to the downstream side. The sheet bundle is conveyed to the downstream side owing to movement of the push-out projection 38 and rotation of the discharging roller device 48, 41. FIG. 10C illustrates a state right before the sheet bundle is discharged onto the first tray 49 at the downstream side. On the processing tray 37, the sheet bundle is conveyed slowly (at low speed) to the downstream side with rotation of the discharging roller device 48, 41. At that time, the push-out projection 38 is kept waiting at the illustrated position as being returned to the initial position (moved rearward).

[Structure of Folding Roller Device]

The folding roller device 64 which folds a sheet bundle and the folding blade 65 which inserts the sheet bundle to a nip position of the folding roller device 64 are arranged at a fold position Y arranged at the downstream side of the second processing portion B2.

The pair of folding rollers 64*a*, 64*b* is formed of a material having a relatively large friction factor such as rubber rollers. This is to perform conveying in the rotational direction while folding a sheet with soft material such as rubber. The pair of folding rollers 64*a*, 64*b* may be formed by performing lining on rubber material.

The pair of folding rollers 64*a*, 64*b* is arranged at a protruded side of the curbed or bent guide member 66. The folding blade 65 having a knife edge is arranged at a position opposed thereto as sandwiching a sheet bundle which is supported by the guide member.

[Sheet Bundle Folding Finishing Mode]

In this mode, the image forming apparatus A forms images on sheets and the sheet post-processing apparatus B performs finishing into a booklet. A sheet fed to the sheet introducing path 28 is introduced to the sheet discharging roller 36. The control CPU 95 stops the sheet discharging roller 36 at the timing when a sheet tailing end passes through a path switching piece with reference to a detection signal of the sheet tailing end detected by the sheet sensor S1. Then, the control CPU 95 reversely rotates the sheet discharging roller 36. Accordingly, the sheet advanced to the sheet introducing path 28 is reversed in the conveying direction and is introduced to the second sheet discharging path 32 via the path switching piece. Then, the sheet is guided to the guide member 66 by the conveying roller which is arranged at the path.

The control CPU 95 moves the regulating stopper 67 at the timing when the sheet is introduced to the guide member 66 from the second sheet discharging path 32. Then, the sheet is supported in whole by the guide member 66.

When a job completion signal is received, the control CPU 95 moves the regulating stopper 67 and the sheet center is set to be positioned at the binding position. Then, the control CPU 95 operates the center-binding stapling unit 63 to perform a staple-binding on one position or a plurality of positions at the sheet center. With a completion signal of the operation, the control CPU 95 moves the regulating stopper 67 and the sheet center is set to be positioned at the fold position Y. Then, the sheet bundle is discharged onto the second stack tray 61 after a folding process is performed on the sheet bundle.

[Description of Control Configuration]

Figure 11:
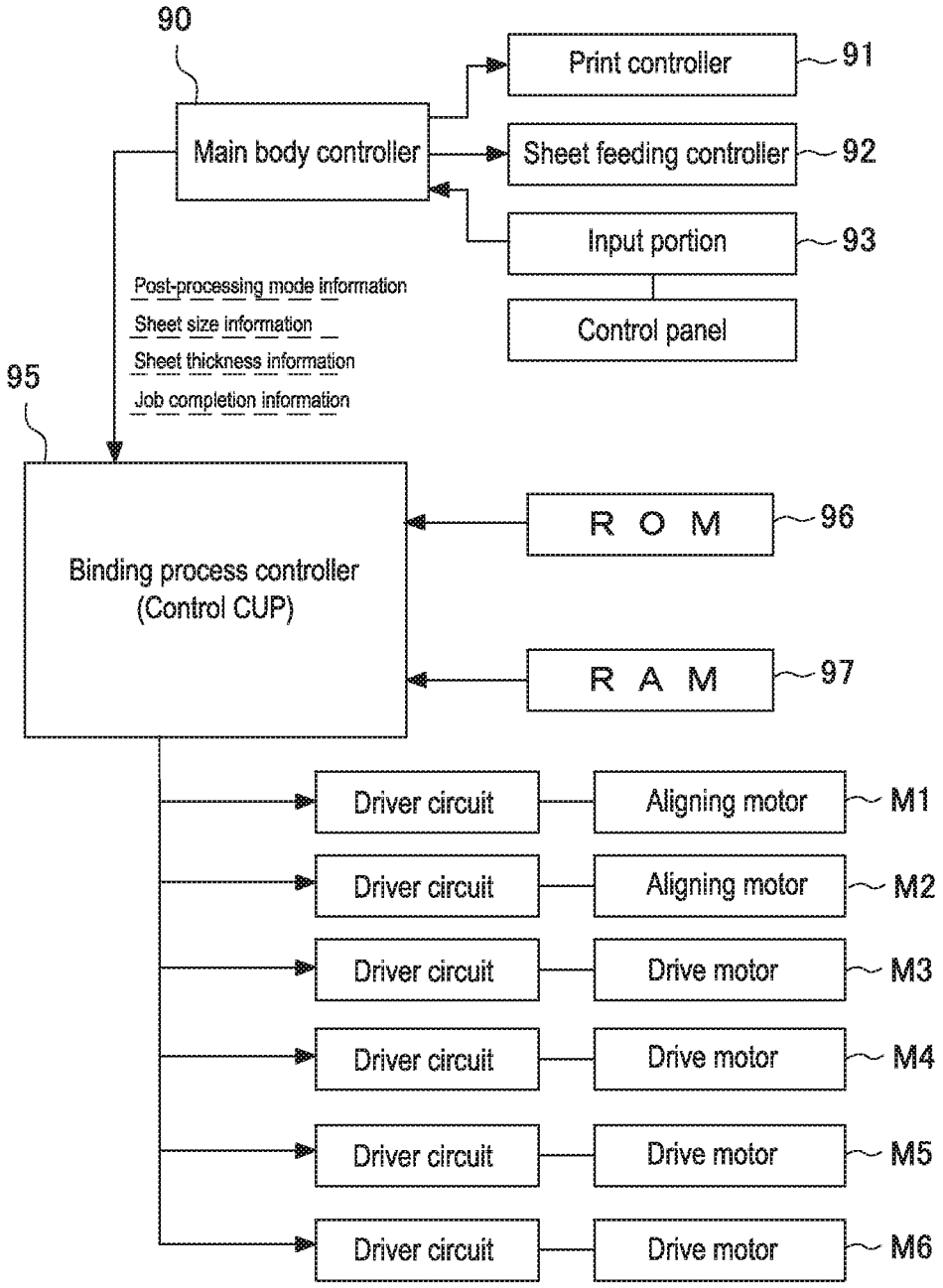
FIG. 11 is a block diagram illustrating a control configuration of the apparatus of FIG. 1.

A control configuration of the image forming system in FIG. 1 will be described with reference to FIG. 11. The image forming system illustrated in FIG. 11 includes a controller (hereinafter, called a main body controller) 90 for the image forming apparatus A and a controller (hereinafter, called a binding process controller) 95 for the sheet post-processing apparatus B. The main body controller 90 includes a print controller 91, a sheet feeding controller 92, and an input portion (control panel) 93.

Setting of an image forming mode and a post-processing mode is performed with the input portion (control panel) 93. The image forming mode requires setting of mode setting such as color/monochrome printing and double-face/single-face printing, and image forming conditions such as a sheet size, sheet quality, the number of copies, and enlarged/reduced printing. The post-processing mode is required to be set, for example, to a printout mode, a staple binding processing mode, an eco-binding processing mode, or a jog sorting mode. Further, the illustrated apparatus includes a manual binding mode. In this mode, operation of a sheet bundle binding process is performed offline as being separate from the main body controller 90 for the image forming apparatus A.

The main body controller 90 transfers, to the binding process controller 95, selection of the post-processing mode and data such as the number of sheets, the number of copies, and thickness of sheets on which images are formed. Further, the main body controller 90 transfers a job completion signal to the binding process controller 75 each time when image forming is completed.

The post-processing mode is described in the following. In the printout mode, a sheet from the sheet discharging port 35 is stored at the stack tray 49 via the processing tray 37 without a binding process performed. In this case, sheets are overlapped and stacked on the processing tray 37 and a stacked sheet bundle is discharged to the stack tray 49 with a jog completion signal from the main body controller 90.

In the staple binding processing mode, sheets from the sheet discharging port 35 are stacked and collated on the processing tray 37 and the sheet bundle is stored on the stack tray 49 after the binding process is performed thereon. In this case, sheets on which images are to be formed are specified by an operator basically to have the same thickness and size. In the staple binding processing mode, any of the multi-binding, right corner binding, and left corner binding is selected and specified. The binding positions thereof are as described above.

In the jog sorting mode, sheets are divided into a group whose sheets having images formed at the image forming apparatus A are offset and stacked and a group whose sheets are stacked without being offset. An offset sheet bundle and a non-offset sheet bundle are alternately stacked on the stack tray 49.

[Manual Binding Mode]

The manual setting portion 77 where an operator sets a sheet bundle on which the binding process is to be performed is arranged at the apparatus front side of the external casing. A sensor to detect a set sheet bundle is arranged at the setting face 77*b* of the manual setting portion 77. With a signal from the sensor, the later-described binding process controller 95 causes the stapling unit 47 to be moved to the manual binding position. Subsequently, when an operation switch is depressed by an operator, the binding process is performed.

Thus, in the manual binding mode, the binding process controller 95 and the main body controller 90 perform controlling offline. Here, in a case that the manual binding mode and the staple binding mode are to be performed concurrently, either mode is set to have priority.

[Binding Process Controller]

The binding process controller 95 causes the post-processing apparatus B to operate in accordance with the post-processing mode set by the image forming controller 90. The illustrated binding process controller 95 is structured with a control CPU (hereinafter, simply called a controller) to which a ROM 96 and a RAM 97 are connected. The control CPU 95 performs the later-described sheet discharging operation with control programs stored in the ROM 96 and control data stored in the RAM 97. Here, drive circuits for all the above mentioned drive motors are connected to the control CPU 95, so that start, stop, and forward-reverse rotation of the motors are controlled thereby.

[Sheet Discharging Operation Mode]

At the controller (main body controller) 90 for the image forming apparatus A, a post-processing (finishing) mode of image-formed sheets is set concurrently with image forming conditions. The illustrated apparatus is set to any of a staple binding mode, an eco-binding mode, a jog sorting mode, a bookbinding mode, a printout mode, an interruption mode, and a manual binding mode. In the following, operations of the respective modes will be described.

Figure 12:
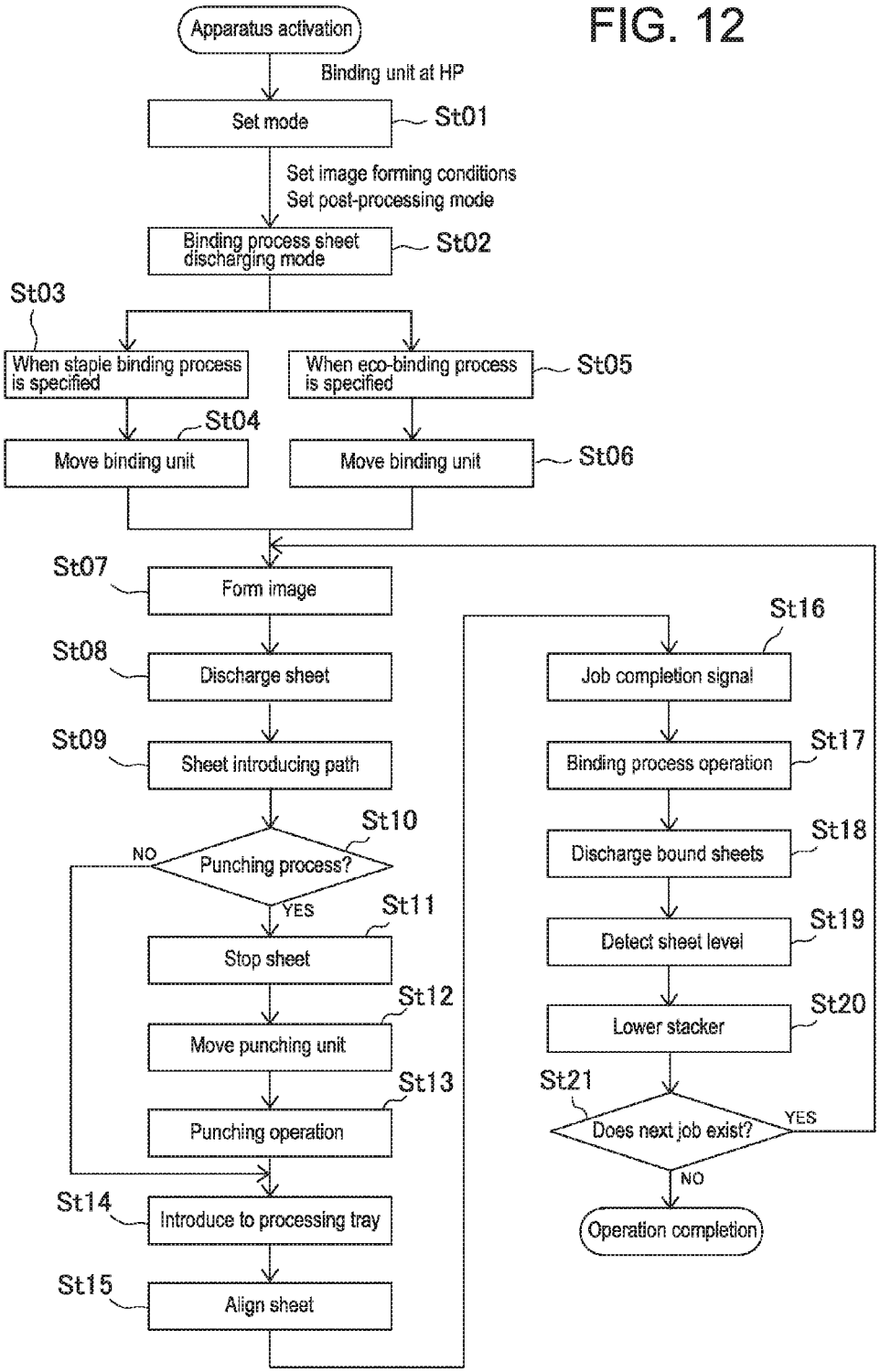
FIG. 12 is a flowchart of binding processing sheet discharging operation.
Figure 13:
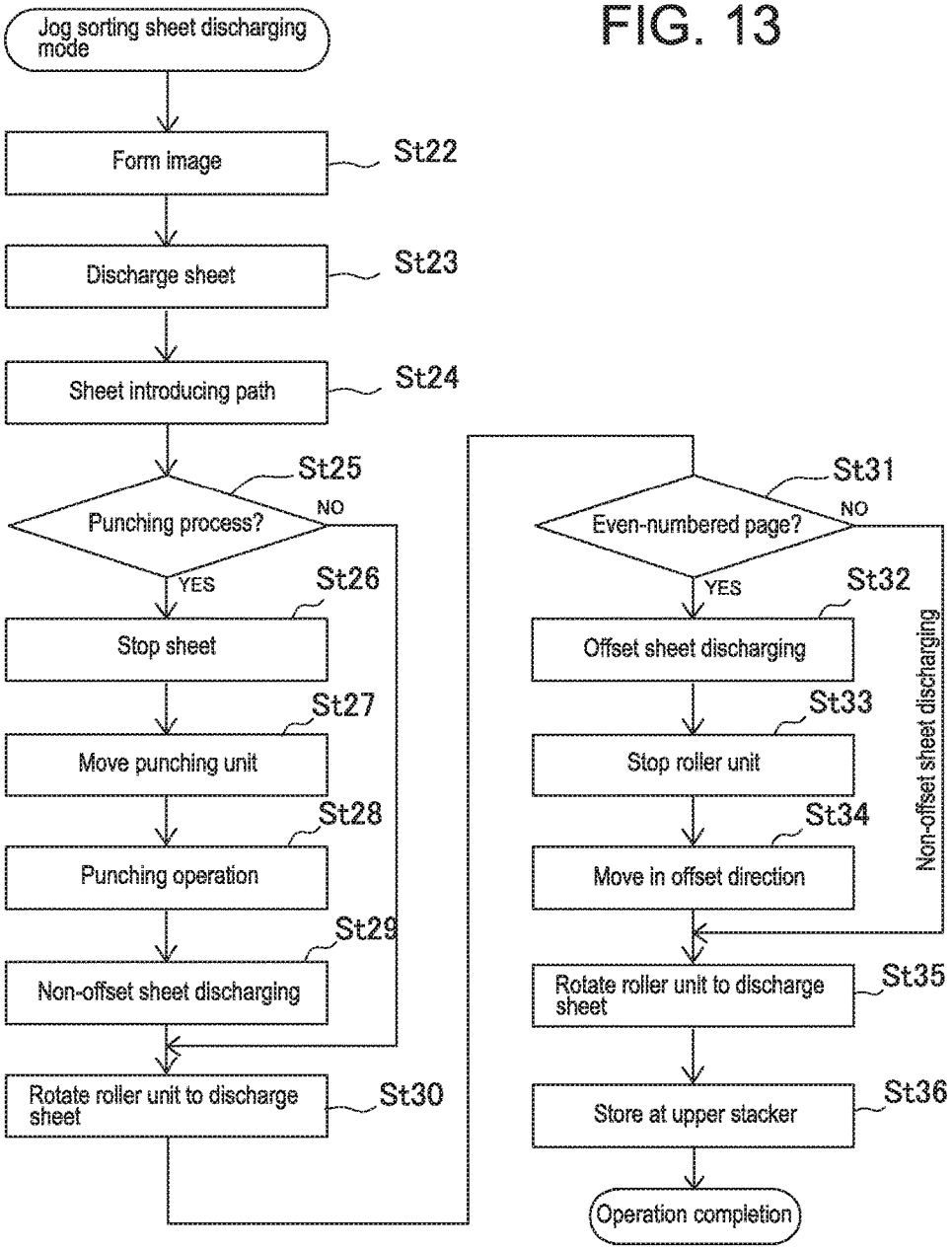
FIG. 13 is an operational flowchart of a jog sorting sheet discharging mode with the apparatus of FIG. 1.
Figure 14A:
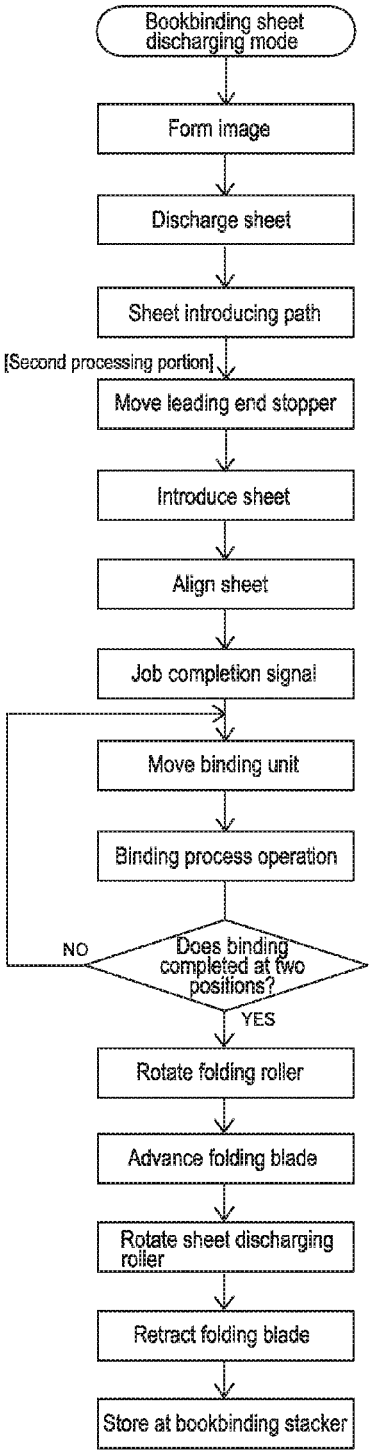
Figure 14B:
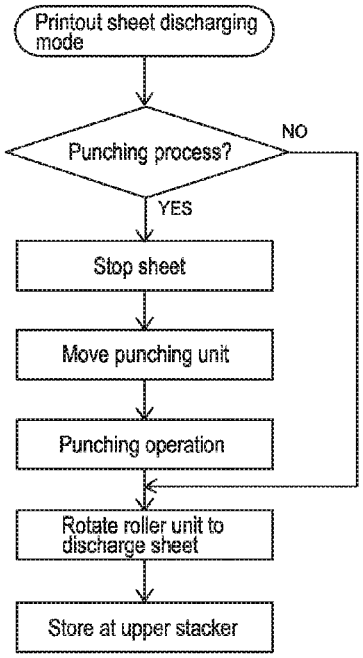

FIG. 12 is an explanatory view of operational flows to store a sheet bundle stacked on the processing tray 37 of the first processing portion B1 at the first tray 49 at the downstream side after the sheet bundle is staple-bound or eco-bound. FIG. 13 is an explanatory view of a sheet discharging mode to perform jog-sorting on sheets for each bundle as being an explanatory view of operational flows to store at the third tray 71 at the downstream side after sheets are offset in a direction perpendicular to the sheet discharging direction by a jog mechanism (roller shift mechanism; not illustrated) of the third processing portion B3 (sheet introducing path). FIG. 14 is an explanatory view of the bookbinding discharging mode to perform bookbinding finishing on sheets at the second processing portion B2.

[Staple Binding Mode and Eco-Binding Mode at First Processing Portion]

In the following, description is provided with reference to FIG. 12. Setting of the post-processing mode is performed with the control panel 93 or the like of the image forming apparatus A (St01). Based on information of the post-processing mode setting, the controller 95 for the sheet post-processing apparatus B causes the binding unit to be moved when the staple binding process is specified (St04). Further, the binding unit is moved as well when the eco-binding process is specified (St05).

For the staple binding process, the first binding unit 47 is moved to the set binding position Cp1 and the second binding unit is moved to the second waiting position Wp2.

Here, when the unit position is set as a home position, the moving is performed after checking whether or not each unit is at the home position.

Next, the image forming apparatus A forms an image (St07) and the image-formed sheet is discharged (St08). The sheet post-processing apparatus B receives the image-formed sheet fed to the introducing port 26 and conveys to the downstream side (St09). When a punching process is specified at that time (St10), the controller 95 causes the sheet to temporarily stop at a punch position (St11). Then, a punching unit 50 is moved in a direction perpendicular to the sheet discharging direction, the punching unit 50 is stopped after a specified punching position is determined with a sheet side edge detected by a sensor, and a punching operation is performed (St13).

When the punching process is not specified, the controller 95 causes the sheet to be received at the introducing port 26 and to be conveyed to the sheet discharging port 35. Then, the sheet is introduced to the processing tray 37 and positioned at a predetermined position by a positioning device (St15). The controller 95 causes sheets fed to the sheet discharging port 35 to be stacked and stored on the sheet placement face 37*a* of the processing tray 37 (St07 to St 15). When a jog completion signal is received from the image forming apparatus A (St16), the controller 95 transmits a binding process instruction signal to the first binding unit 47 or the second binding unit 51. Accordingly, the first binding unit 47 or the second binding unit 51 performs the binding process (St17).

When the controller 95 receives a binding process completion signal from the first or second binding unit 47, 51, the bound sheet bundle is stored onto the first tray 49 at the downstream side by the sheet bundle discharging mechanism (St18). A sheet level detection sensor (not illustrated) is arranged at the first tray 49 and detects a stacked-sheet height. When the detection value exceeds a predetermined height, the first tray 49 is lowered (St20). Subsequently, the controller 95 determines whether or not a next job exists (St21) and the operation is completed.

Next, the jog sorting sheet discharging mode will be described with reference to FIG. 13. When the punching process is specified, the controller 95 causes a sheet fed to the sheet introducing port 26 of the sheet introducing path 28 to temporarily stop at the punching position (St25). Then, the punching unit 50 is moved in a direction perpendicular to the sheet discharging direction, the punching unit 50 is stopped after a specified punching position is determined with a sheet side edge detected by the sensor, and the punching operation is performed (St27).

Subsequently, the controller 95 causes a roller unit to be rotated in the sheet discharging direction (St30) to discharge a sheet from the third sheet discharging path 30 to the third tray 71. When the sheet is at an even-numbered page, the roller unit is stopped (St33) and the sheet is moved in a nipped state in a direction perpendicular to the sheet discharging direction by a previously-set offset amount (St34). Then, the controller 95 causes the roller unit to be rotated again in the sheet discharging direction (St35). At that time, the first path switching device 33 is shifted to guide the sheet from the introducing port 26 to the third sheet discharging path 30 and the sheet is stacked on the third tray 71 (St36).

Next, the bookbinding sheet discharging mode will be described with reference to FIG. 14. Similarly to the above, an image-formed sheet is introduced to the sheet introducing path 28. The sheet is guided from the introducing port 26 to the second processing portion B2 and is abutted and regulated by the leading end regulating stopper 67. At that time, the controller 95, in advance, receives information of sheet size in the sheet discharging direction and sets a position of the leading end regulating stopper 67.

With a job completion signal from the image forming apparatus A, the binding unit (center binding unit) is moved to the sheet center and performs a binding process on sheets stacked at the second processing portion B2. When the binding process is completed at one position or two positions, the sheet bundle is moved to a folding position and a folding roller 64 is rotated. At the time when a folding blade 65 is advanced in the folding direction and the folding roller 64 is rotated by a predetermined amount, the folding blade 65 is retracted. Then, the folded-sheets are discharged in the sheet discharging direction by a sheet discharging roller 69 at the downstream side and stored at the second tray 61.

The present invention is described based on the present embodiment which adopts the sheet post-processing apparatus B including the stapling unit (first binding unit) 47 and the eco-binding unit (second binding unit) 51 having different binding processing capacities with respect to the number of sheets to be processed. However, not limited thereto, the present invention can be applied to a sheet post-processing apparatus which adopts a plurality of binding processing units having the same binding processing capacities with respect to the number of sheets to be processed.

Further, the present invention is described based on the sheet post-processing apparatus including the stapling unit to perform a binding process on a sheet bundle using a staple and the eco-binding unit (second binding unit) to perform a binding process on a sheet bundle without using a staple. However, not limited thereto, the present invention can be applied to a sheet post-processing apparatus which adopts a plurality of stapling units having different binding processing capacities with respect to the number of sheets to be processed.

What is claimed is:

1. A sheet processing apparatus, comprising:

a stack portion on which sheets conveyed in a conveying direction are stacked;

a first regulating portion which is configured to regulate a position of a sheet bundle stacked on the stack portion, the first regulating portion regulating the position of the sheet bundle in a crossing direction crossing the conveying direction by contacting an end of the sheet bundle in the crossing direction;

a second regulating portion which is configured to regulate a position of a sheet bundle, stacked on the stack portion, in the conveying direction by contacting an end of the sheet bundle in the conveying direction;

a first binding device which is configured to move in the crossing direction so that the first binding device moves from a first side of the sheet processing apparatus to a second side of the sheet processing apparatus and moves from the second side to the first side, and which is configured to bind a corner portion of a sheet bundle by a staple, the corner portion including an end where the first regulating portion has contacted and an end where the second regulating portion has contacted, the corner portion being on the first side of the sheet bundle;

a second binding device which is configured to bind a corner portion of a sheet bundle without a staple, the corner portion including an end where the first regulating portion has contacted and an end where the second regulating portion has contacted, the corner portion being on the first side of the sheet bundle, the second binding device including a first pressurizing portion and a second pressurizing portion, the first pressurizing portion and the second pressurizing portion being sandwiching the sheet bundle in a case that the second binding device binds the sheet bundle, the first pressurizing portion and the second pressurizing portion being configured to move integrally; and a controller which is configured to cause, in a case that the first binding device binds a corner portion of a sheet bundle the second binding device to be positioned outside the sheet bundle, the corner portion including an end where the first regulating portion has contacted and an end where the second regulating portion has contacted, the corner portion being on first side of the sheet bundle, and which is configured to cause, in a case that the second binding device binds a corner portion of a sheet bundle, the first binding device to be positioned at the second side relative to the second binding device, the corner portion including an end where the first regulating portion has contacted and an end where the second regulating portion has contacted, the corner portion being on first side of the sheet bundle.

2. The sheet processing apparatus according to claim 1, wherein the first binding device binds an end, where the second regulating portion has contacted, of a sheet bundle at several positions in the crossing direction.

3. The sheet processing apparatus according to claim 1, wherein in a case that the second binding device binds a corner portion of a sheet bundle, the controller causes the first binding device to be positioned on the second side relative to an end on the second side of the sheet bundle, wherein the corner portion includes an end where the first regulating portion has contacted and an end where the second regulating portion has contacted, and the corner portion is on the first side of the sheet bundle.

4. The sheet processing apparatus according to claim 1, wherein the second binding device is configured to move in the crossing direction, and in a case that the first binding device binds a corner portion of a sheet bundle, the controller causes the second binding device to be positioned on the first side relative to an end of the first side of the sheet bundle, and on the first side relative to the first binding device, wherein the corner portion includes an end where the first regulating portion has contacted and an end where the second regulating portion has contacted, and the corner portion is on the first side of the sheet bundle.

5. The sheet processing apparatus according to claim 1, wherein a distance where the first binding device moves is longer than a distance where the second binding device moves.

6. The sheet processing apparatus according to claim 1, wherein the second regulating portion regulates a sheet bundle in the conveying direction by contacting an end of the sheet bundle at an upstream side in the conveying direction.

7. The sheet processing apparatus according to claim 6, further comprising:

a discharge portion which is configured to discharge a sheet bundle on the stack portion from the stack portion by moving the sheet bundle in the conveying direction.

8. An image forming apparatus, comprising:

an image forming device for forming an image on a sheet, a stack portion on which the sheet conveyed from the image forming device in a conveying direction is stacked;

a first regulating portion which is configured to regulate a position of a sheet bundle stacked on the stack portion, the first regulating portion regulating the position of the sheet bundle in a crossing direction crossing the conveying direction by contacting an end of the sheet bundle in the crossing direction;

a second regulating portion which is configured to regulate a position of a sheet bundle, stacked on the stack portion, in the conveying direction by contacting an end of the sheet bundle in the conveying direction;

a first binding device which is configured to move in the crossing direction so that the first binding device moves from a first side of the sheet processing apparatus to a second side of the sheet processing apparatus and moves from the second side to the first side, and which is configured to bind a corner portion of a sheet bundle by a staple, the corner portion including an end where the first regulating portion has contacted and an end where the second regulating portion has contacted, the corner portion being on the first side of the sheet bundle;

a second binding device which is configured to bind a corner portion of a sheet bundle without a staple, the corner portion including an end where the first regulating portion has contacted and an end where the second regulating portion has contacted, the corner portion being on the first side of the sheet bundle, the second binding device including a first pressurizing portion and a second pressurizing portion, the first pressurizing portion and the second pressurizing portion sandwiching the sheet bundle and in a case that the second binding device binds the sheet bundle, the first pressurizing portion and the second pressurizing portion being configured to move integrally; and a controller which is configured to cause, in a case that the first binding device binds a corner portion of a sheet bundle, the second binding device to be positioned outside the sheet bundle, the corner portion including an end where the first regulating portion has contacted and an end where the second regulating portion has contacted, the corner portion being on the first side of the sheet bundle, and which is configured to cause, in a case that the second binding device binds a corner portion of a sheet bundle, the first binding device to be positioned at the second side relative to the second binding device, the corner portion including an end where the first regulating portion has contacted and an end where the second regulating portion has contacted, the corner portion being on the first side of the sheet bundle.

* * * * *